US012070787B2

(12) United States Patent
Sugawara et al.

(10) Patent No.: US 12,070,787 B2
(45) Date of Patent: Aug. 27, 2024

(54) PRESS FORMING METHOD AND PRESS APPARATUS

(71) Applicant: NIPPON STEEL CORPORATION, Tokyo (JP)

(72) Inventors: Minoru Sugawara, Tokyo (JP); Yasuharu Tanaka, Tokyo (JP); Takashi Miyagi, Tokyo (JP); Misao Ogawa, Tokyo (JP); Junki Natori, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 633 days.

(21) Appl. No.: 17/425,614

(22) PCT Filed: Jan. 24, 2020

(86) PCT No.: PCT/JP2020/002618
§ 371 (c)(1),
(2) Date: Jul. 23, 2021

(87) PCT Pub. No.: WO2020/153500
PCT Pub. Date: Jul. 30, 2020

(65) Prior Publication Data

US 2022/0097116 A1 Mar. 31, 2022

(30) Foreign Application Priority Data

Jan. 25, 2019 (JP) ..... 2019-011631

(51) Int. Cl.
*B21D 22/22* (2006.01)
*B21D 19/08* (2006.01)
(Continued)

(52) U.S. Cl.
CPC ..... *B21D 22/22* (2013.01); *B21D 19/08* (2013.01); *B21D 24/04* (2013.01); *B21D 53/88* (2013.01)

(58) Field of Classification Search
CPC ..... B21D 22/22; B21D 22/26; B21D 24/04; B21D 19/08; B21D 53/88
See application file for complete search history.

(56) References Cited

U.S. PATENT DOCUMENTS

2012/0297853 A1 11/2012 Tanaka et al.
2015/0298193 A1* 10/2015 Urabe ..... B21D 22/26 72/379.2
(Continued)

FOREIGN PATENT DOCUMENTS

CA 3 039 456 A1 4/2018
EP 0 150 818 B1 4/1990
(Continued)

*Primary Examiner* — Teresa M Ekiert
(74) *Attorney, Agent, or Firm* — Birch, Stewart, Kolasch & Birch, LLP

(57) ABSTRACT

A press forming method includes a first step of pinching one part of a metal sheet by means of a die and a pad, and a second step of moving a punch in a direction in which the punch approaches the die relatively to perform press forming on the metal sheet. The die has a first support surface which has an edge including a curved portion. The pad has a second support surface facing the first support surface of the die. The first support surface includes a first flat portion, and a first deformation portion which protrudes or is recessed with respect to the first flat portion. The second support surface includes a second flat portion which faces the first flat portion, and a second deformation portion which is recessed or protrudes with respect to the second flat portion so as to correspond to the first deformation portion. The first deformation portion is provided on a normal line of the curved portion as viewed from a pressing direction. When a space between the first deformation portion and the second deformation portion is assumed to be a deformation space, in the second step, press forming is performed so that portions of the metal sheet which are on both sides of the
(Continued)

deformation space flow into the deformation space, and the metal sheet deforms along the first deformation portion and the second deformation portion in the deformation space.

15 Claims, 22 Drawing Sheets

(51) Int. Cl.
*B21D 24/04* (2006.01)
*B21D 53/88* (2006.01)

(56) References Cited

U.S. PATENT DOCUMENTS

| | | | | |
|---|---|---|---|---|
| 2016/0200363 | A1 | 7/2016 | Ito et al. | |
| 2017/0021870 | A1* | 1/2017 | Ito | B21D 22/26 |
| 2018/0185899 | A1* | 7/2018 | Saito | B21D 22/26 |

FOREIGN PATENT DOCUMENTS

| | | | |
|---|---|---|---|
| JP | 6128226 | B2 | 5/2017 |
| KR | 10-1581726 | B1 | 12/2015 |
| WO | WO 2011/145679 | A1 | 11/2011 |

* cited by examiner

[Figure 1]
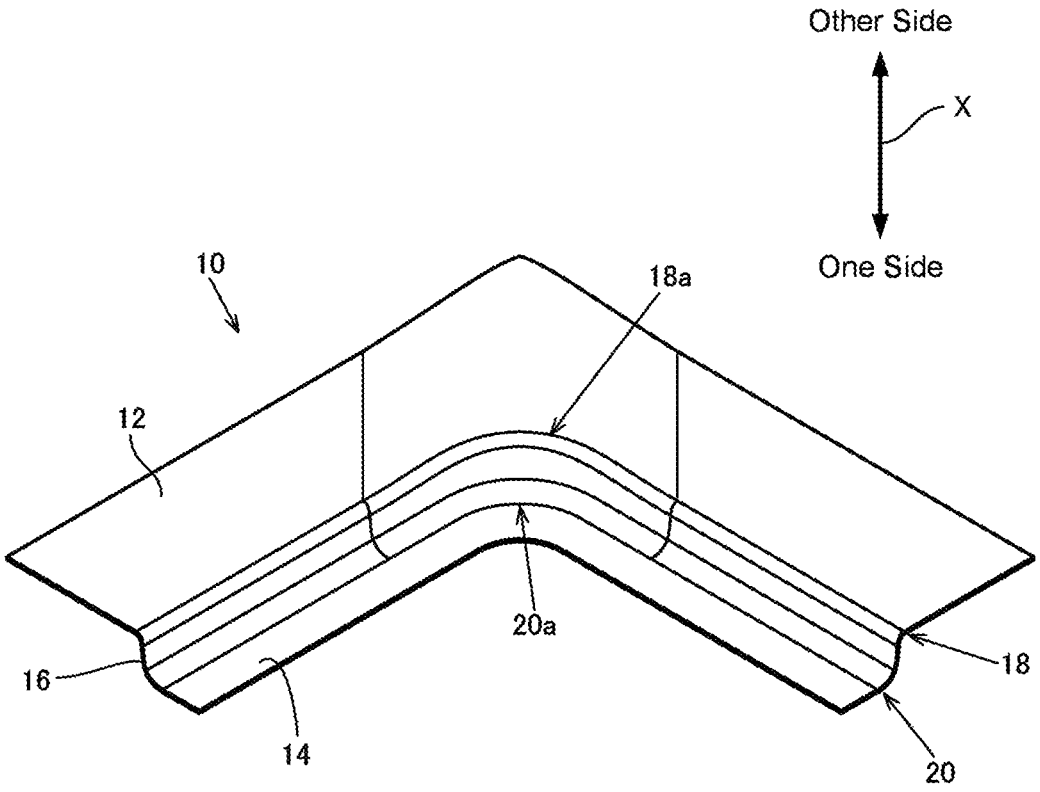

[Figure 2]
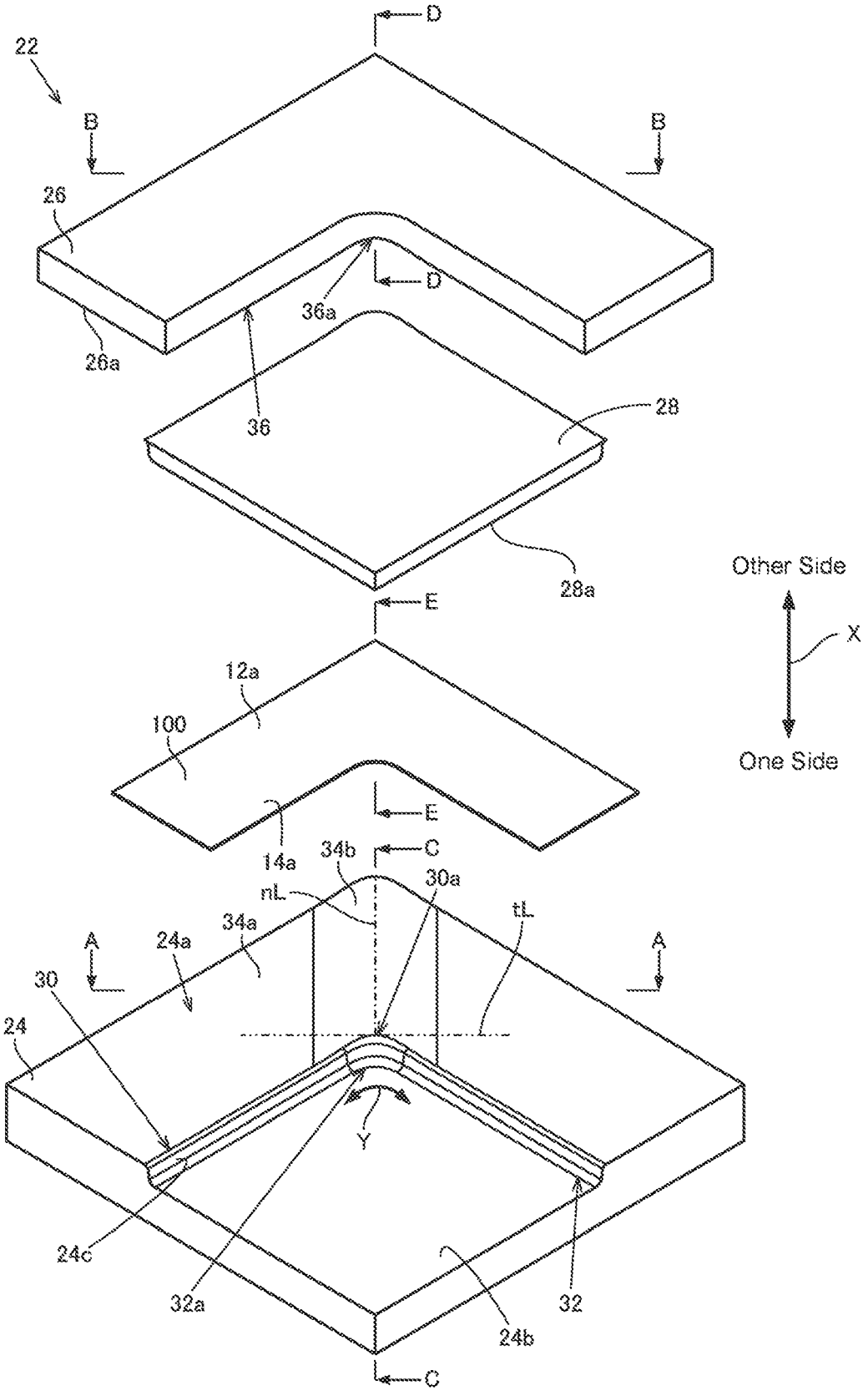

[Figure 3]
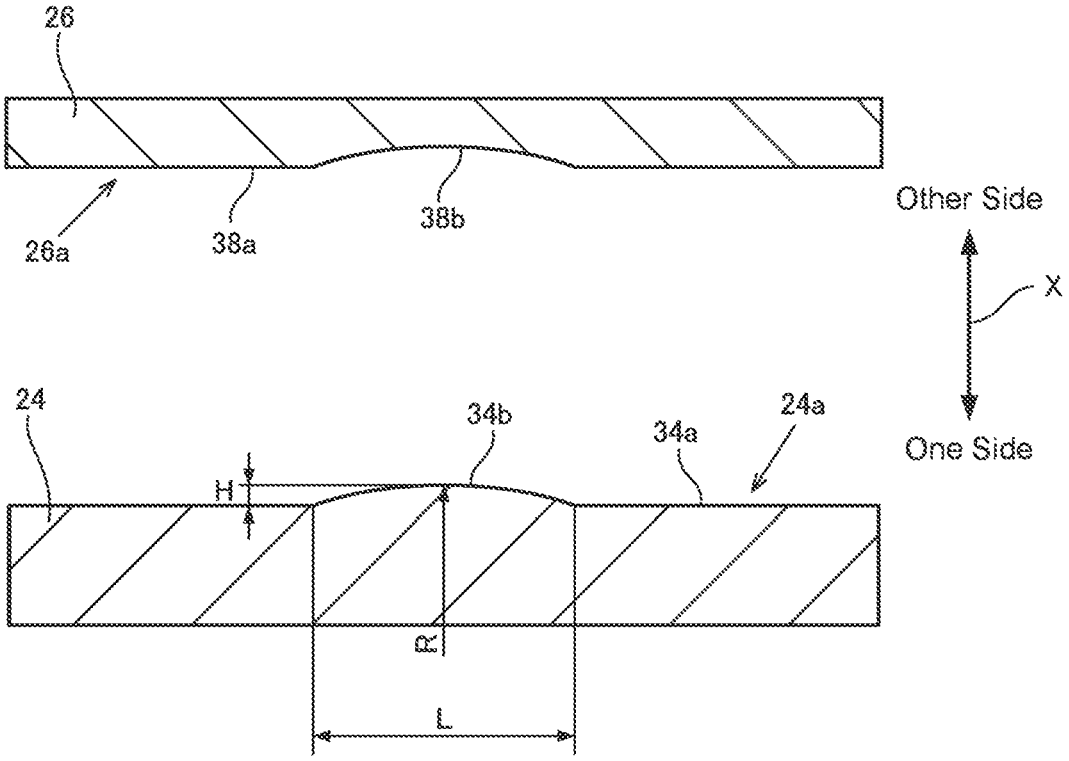
[Figure 4]
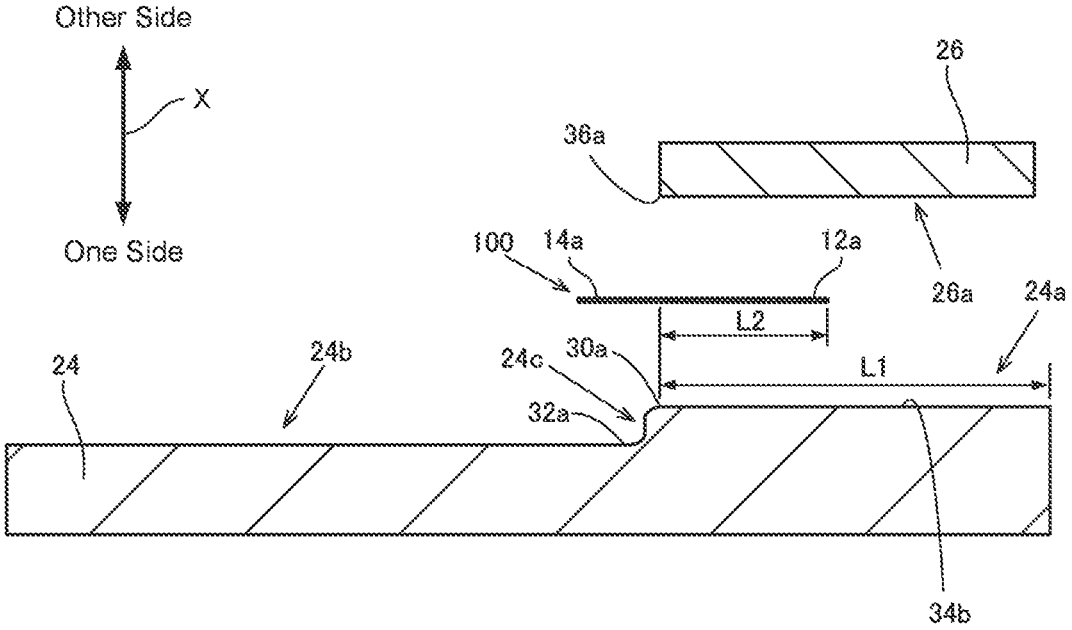

[Figure 5]
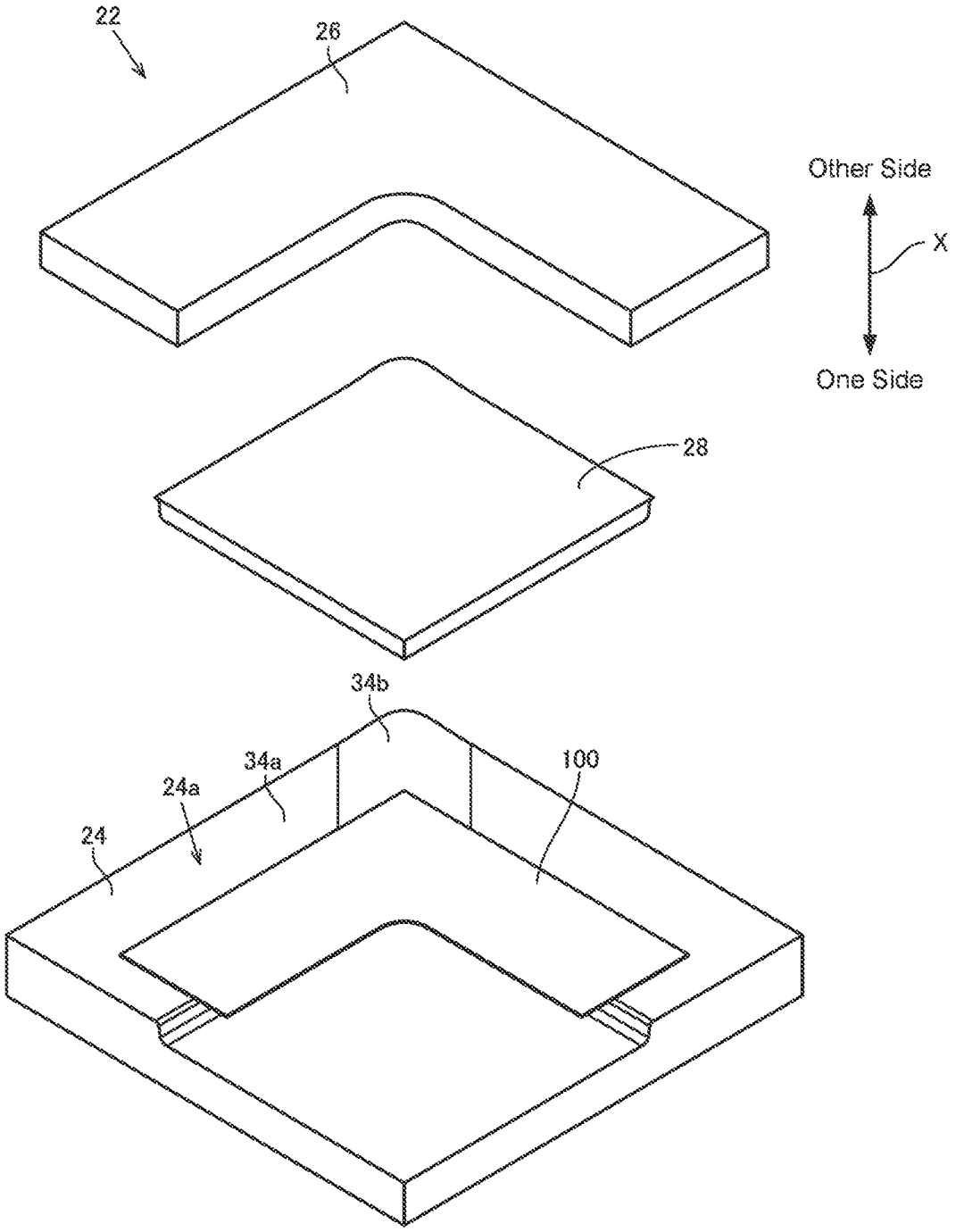

[Figure 6]
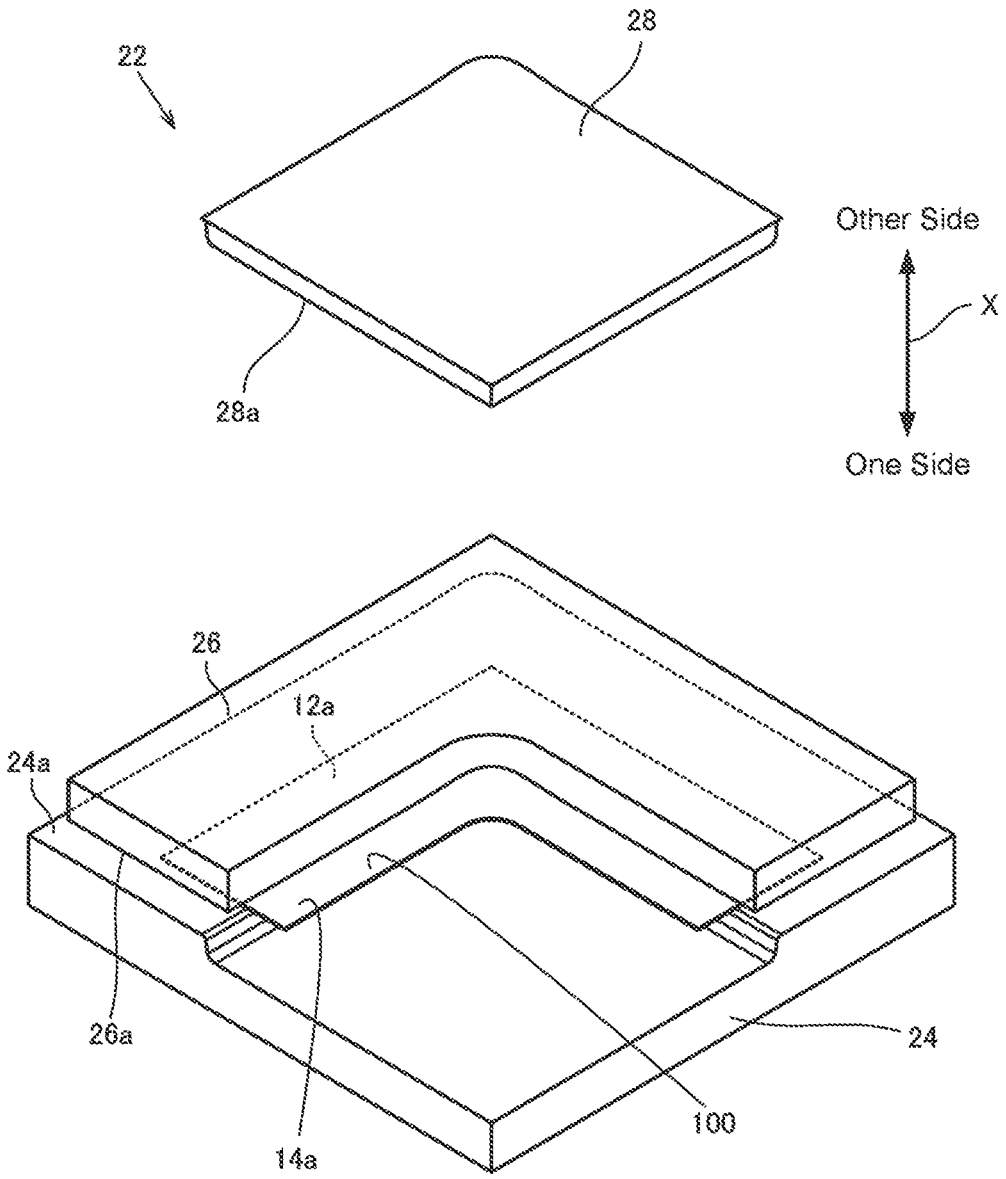

[Figure 7]
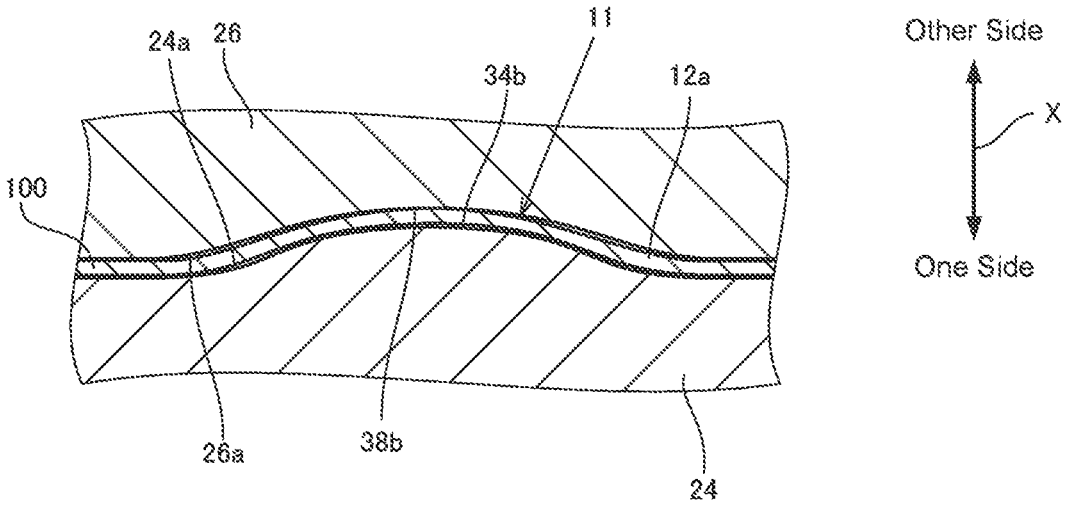
[Figure 8]
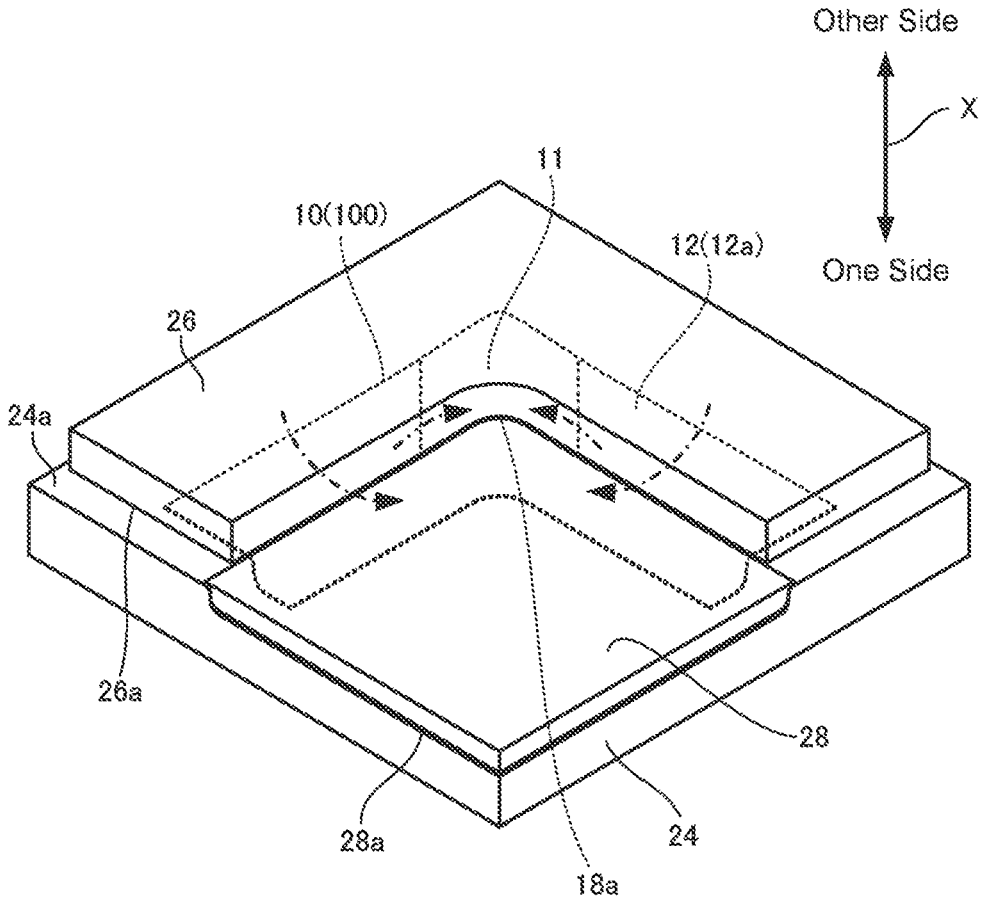

[Figure 9]
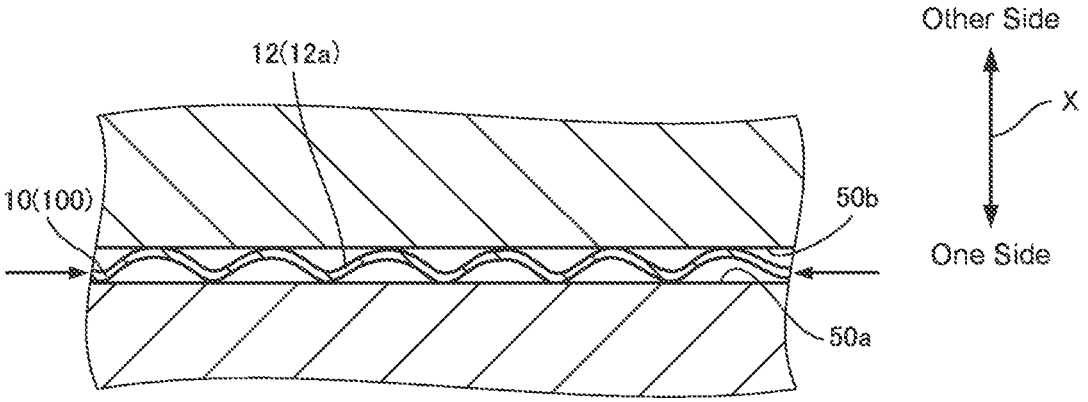
[Figure 10]
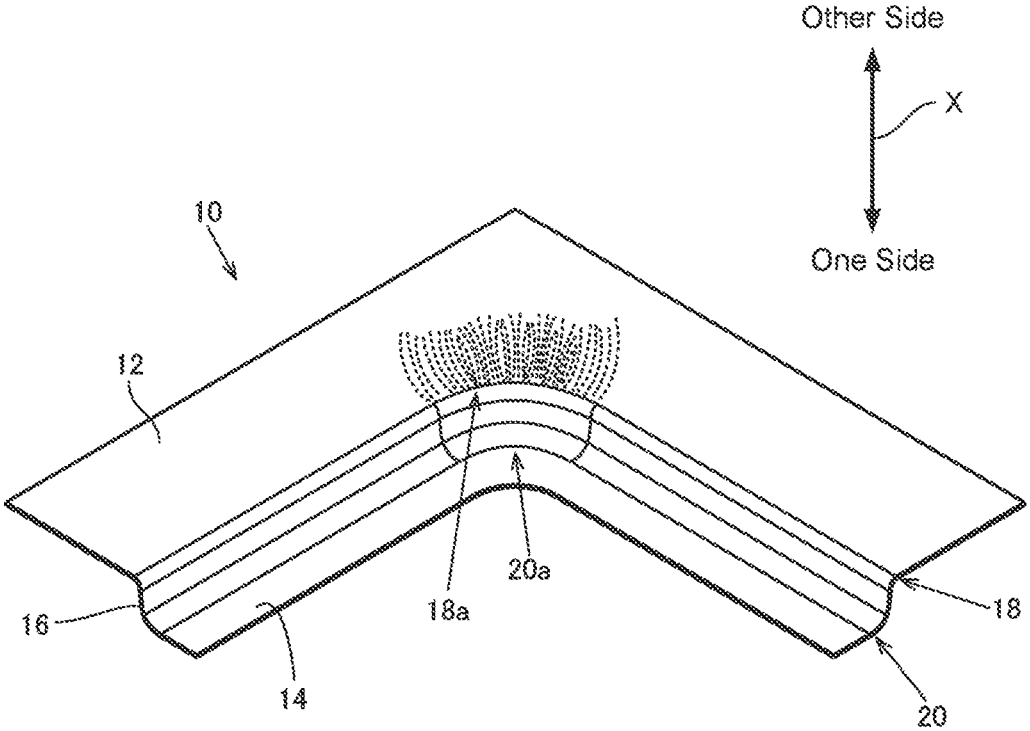

[Figure 11]
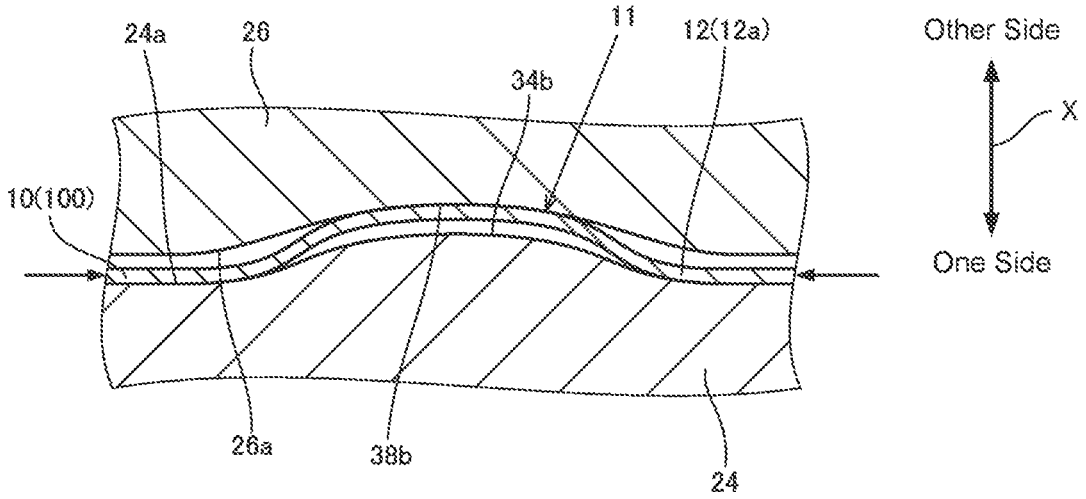
[Figure 12]
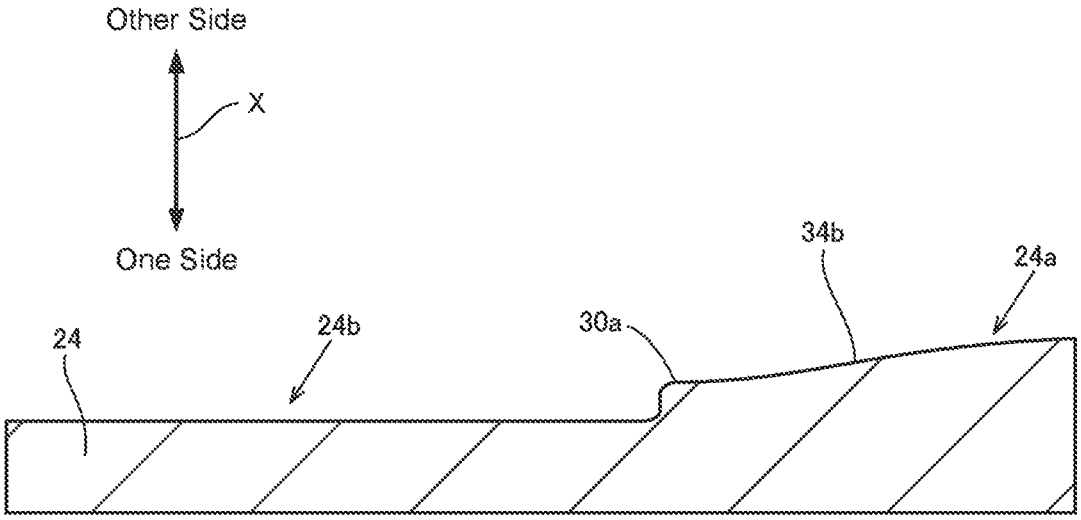

[Figure 13]
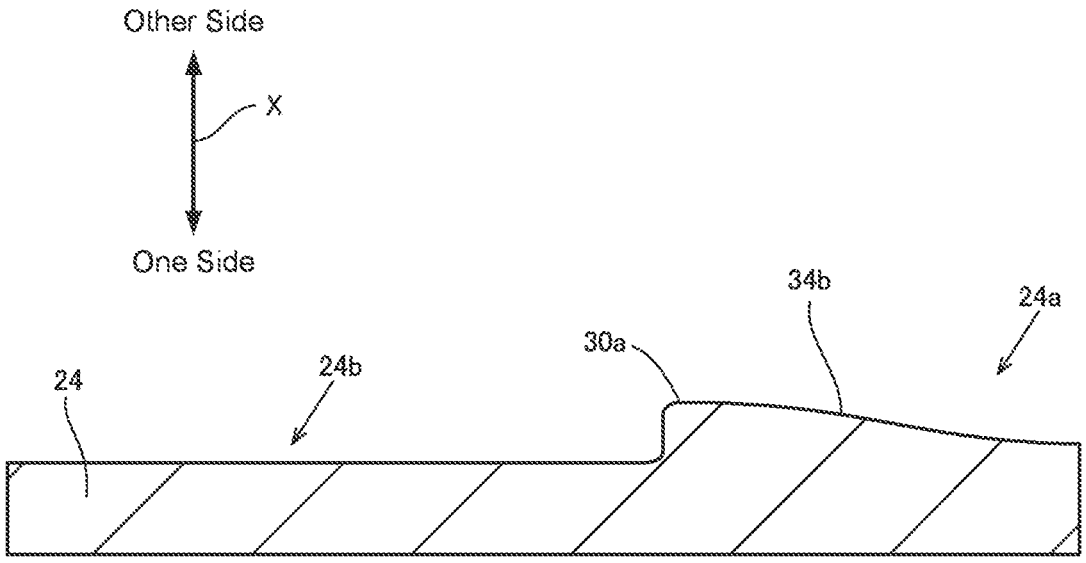
[Figure 14]
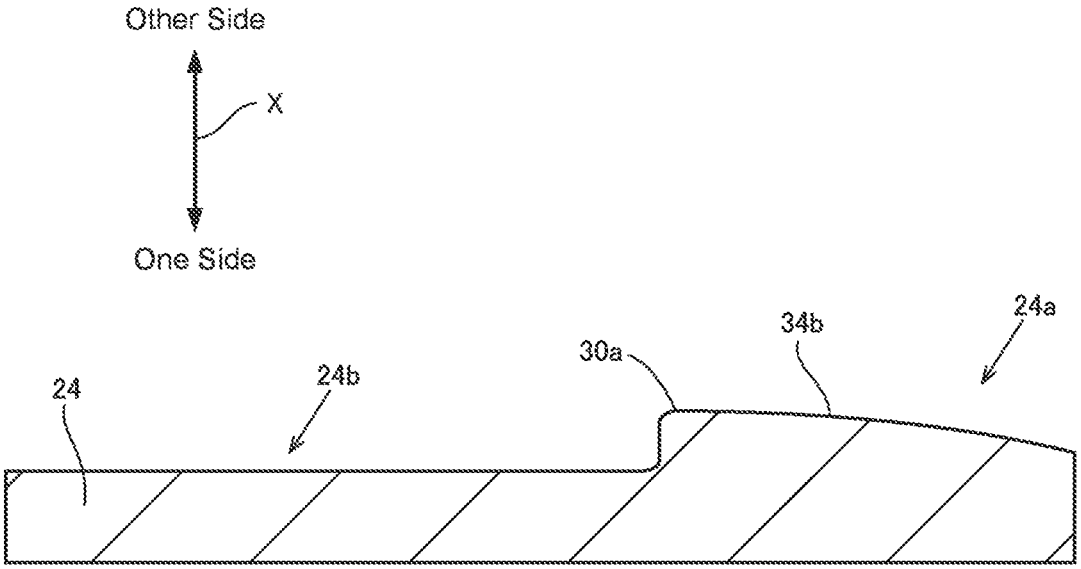

[Figure 15]
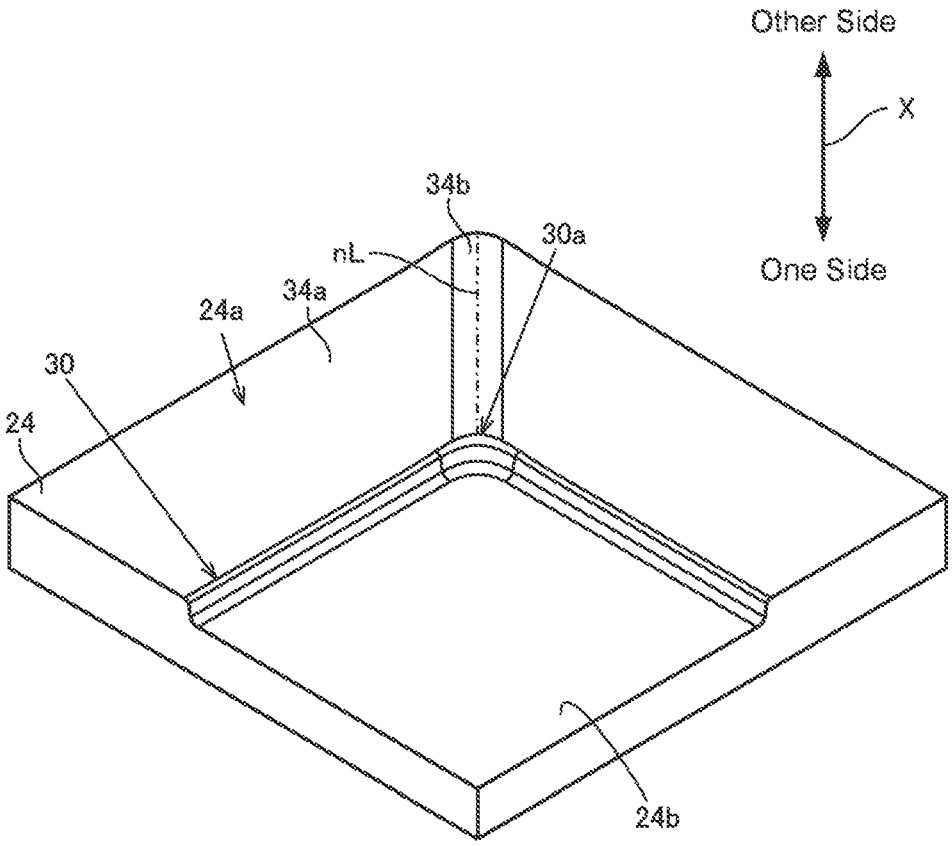

[Figure 16]
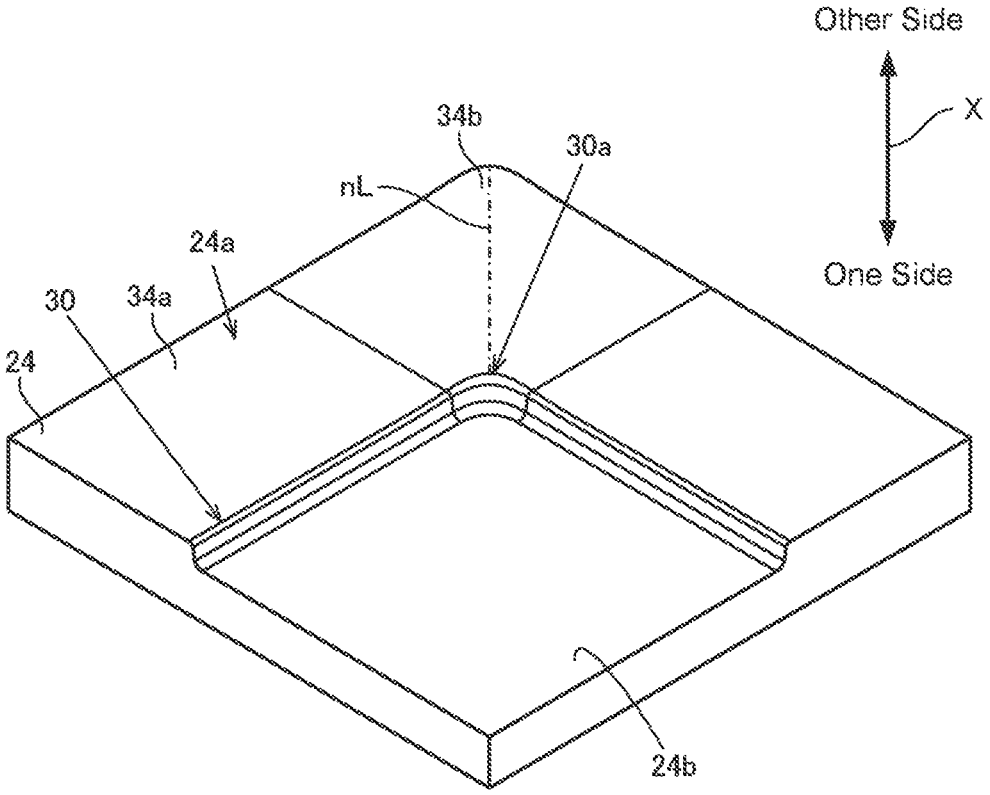

[Figure 17]
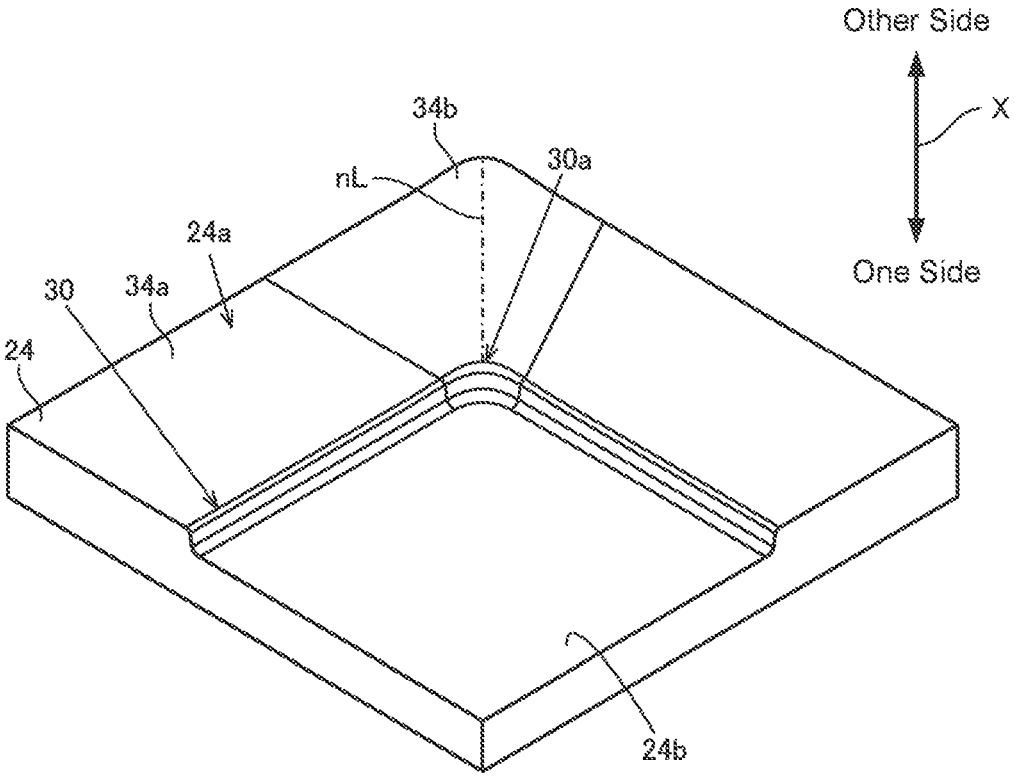

[Figure 18]
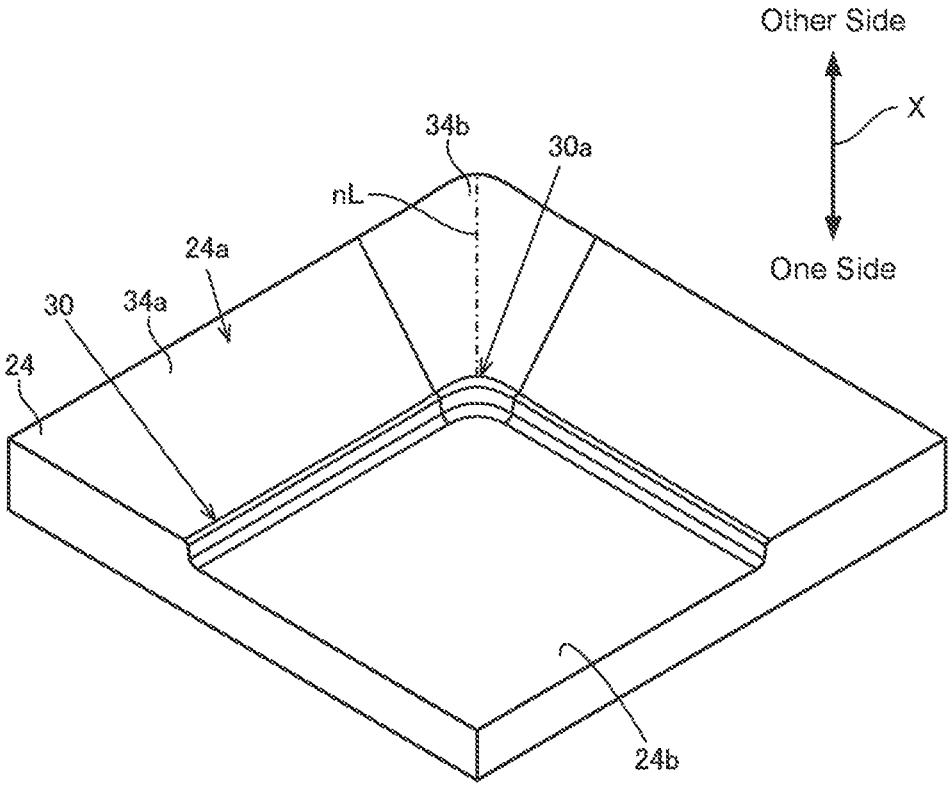

[Figure 19]
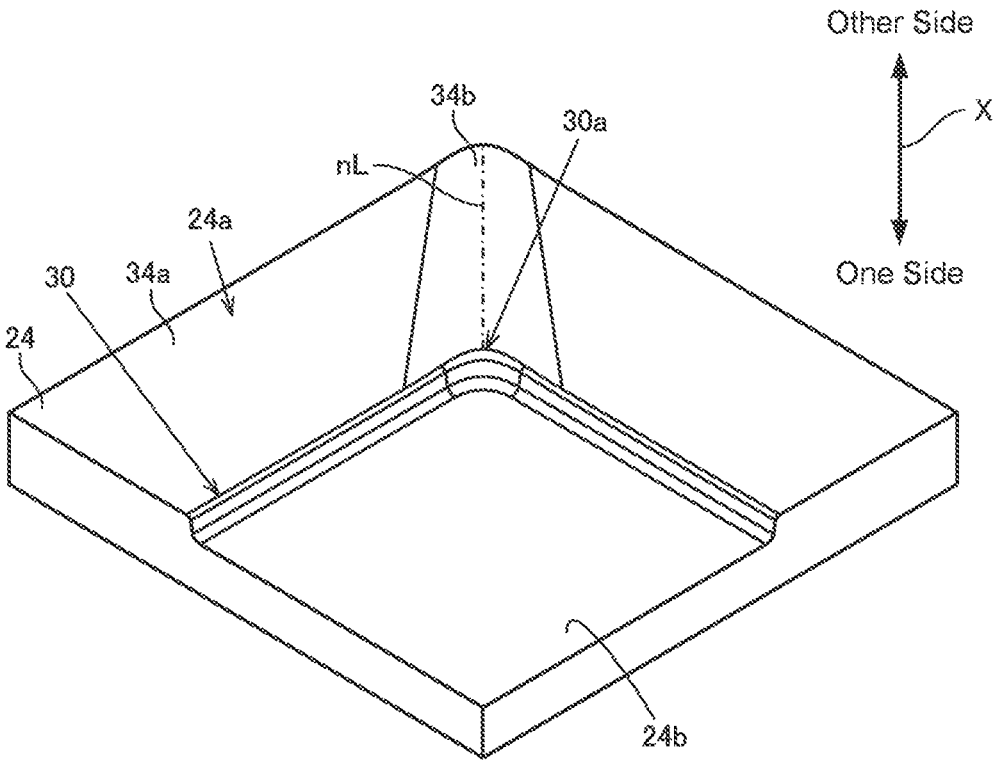
[Figure 20]
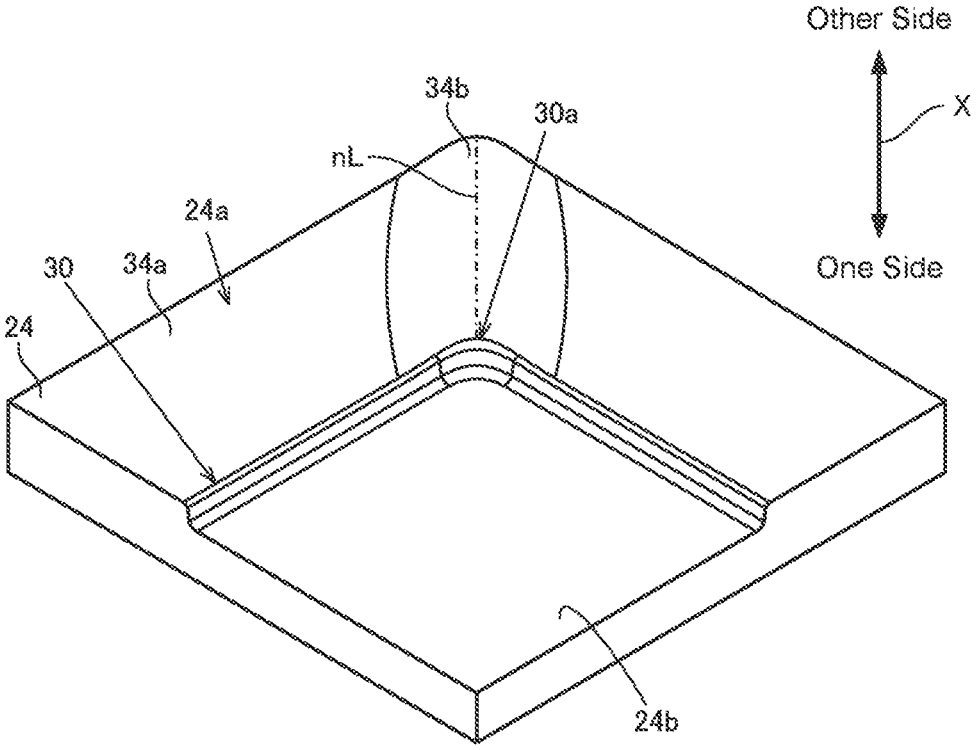

[Figure 21]
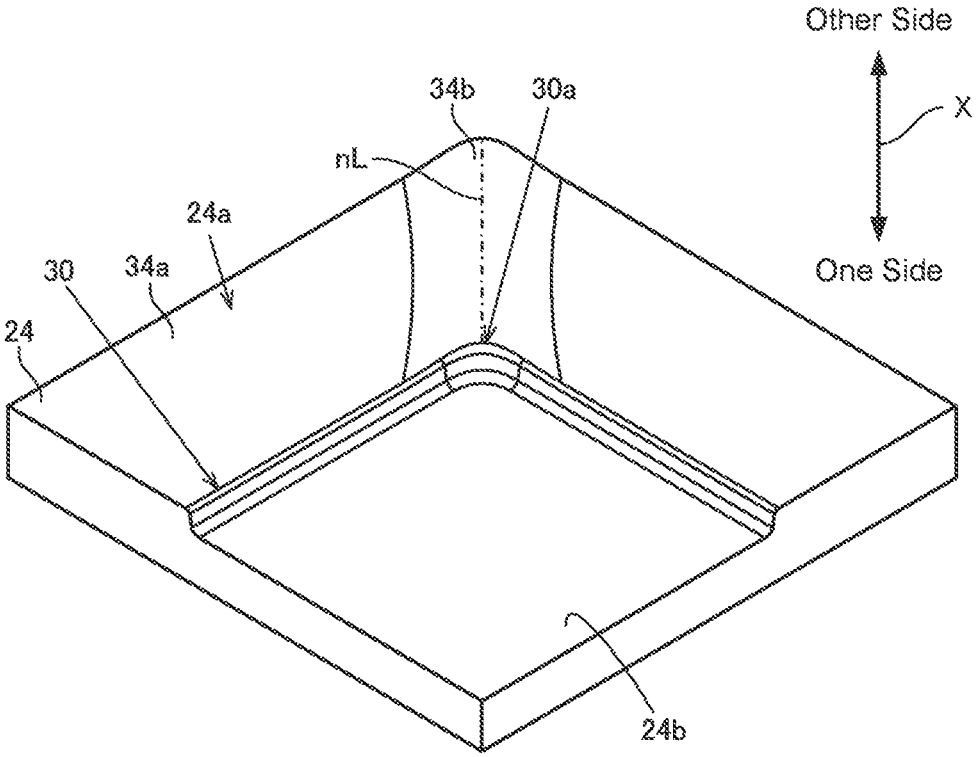
[Figure 22]
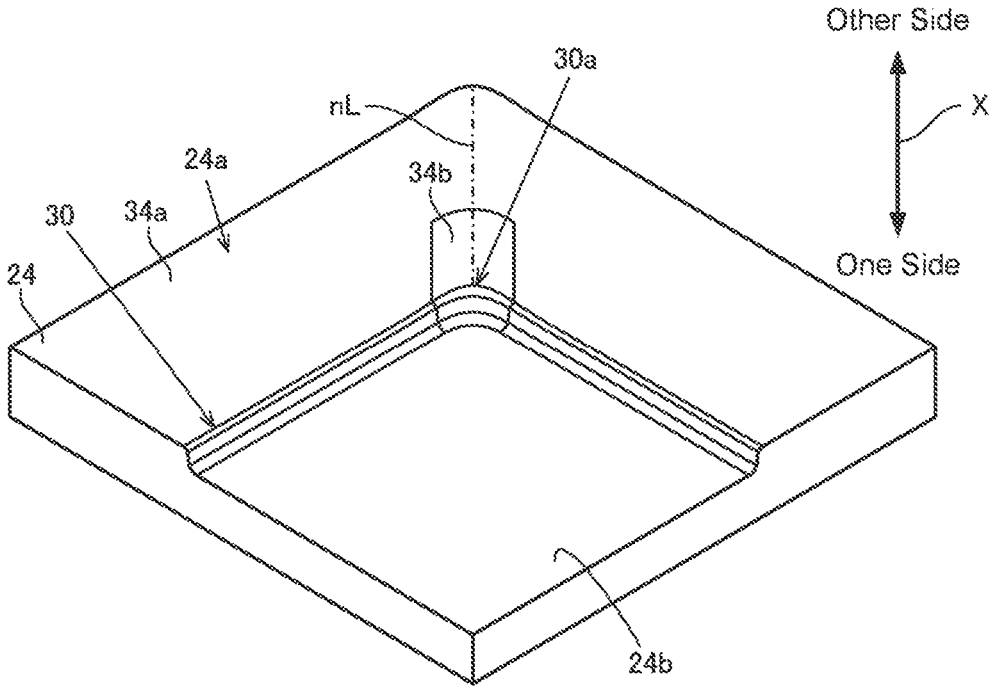

[Figure 23]
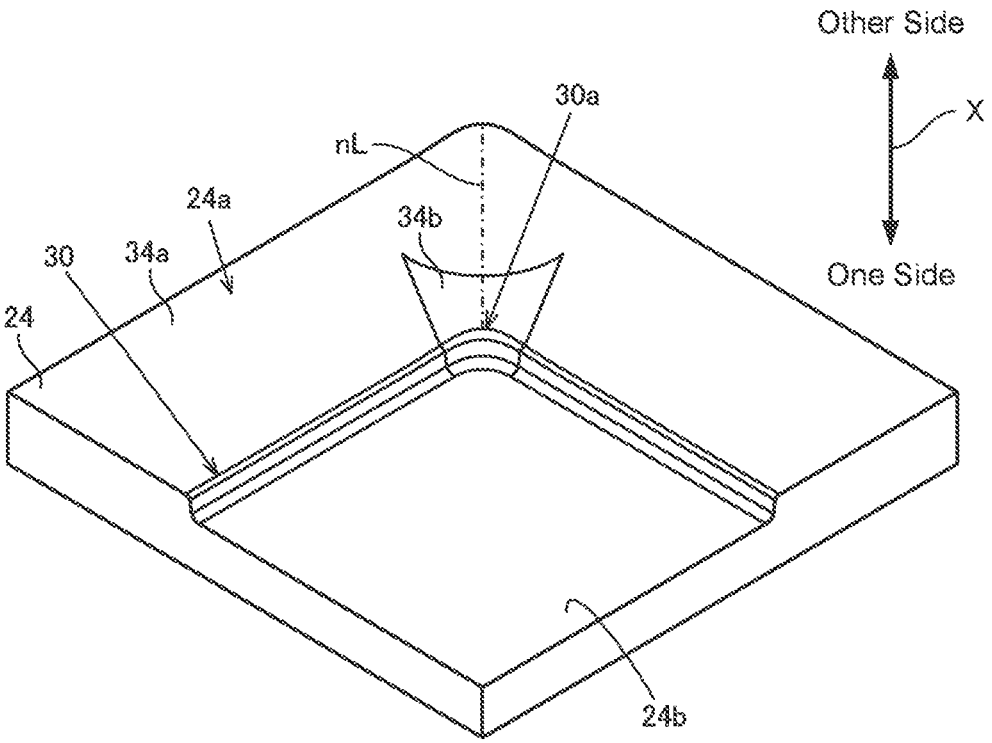
[Figure 24]
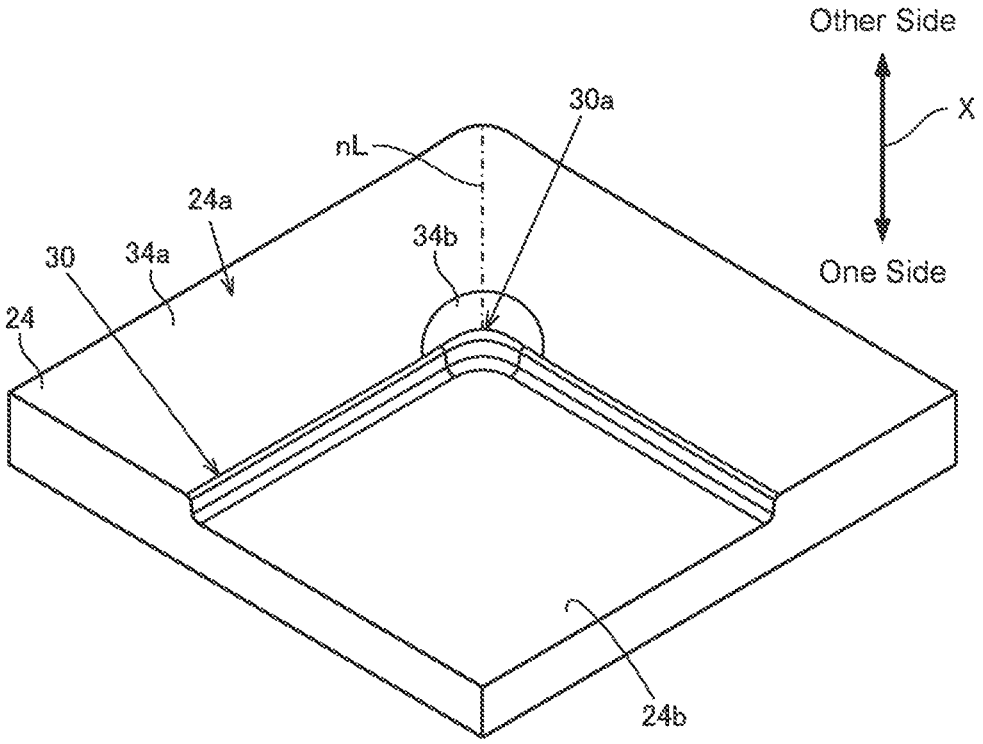

[Figure 25]
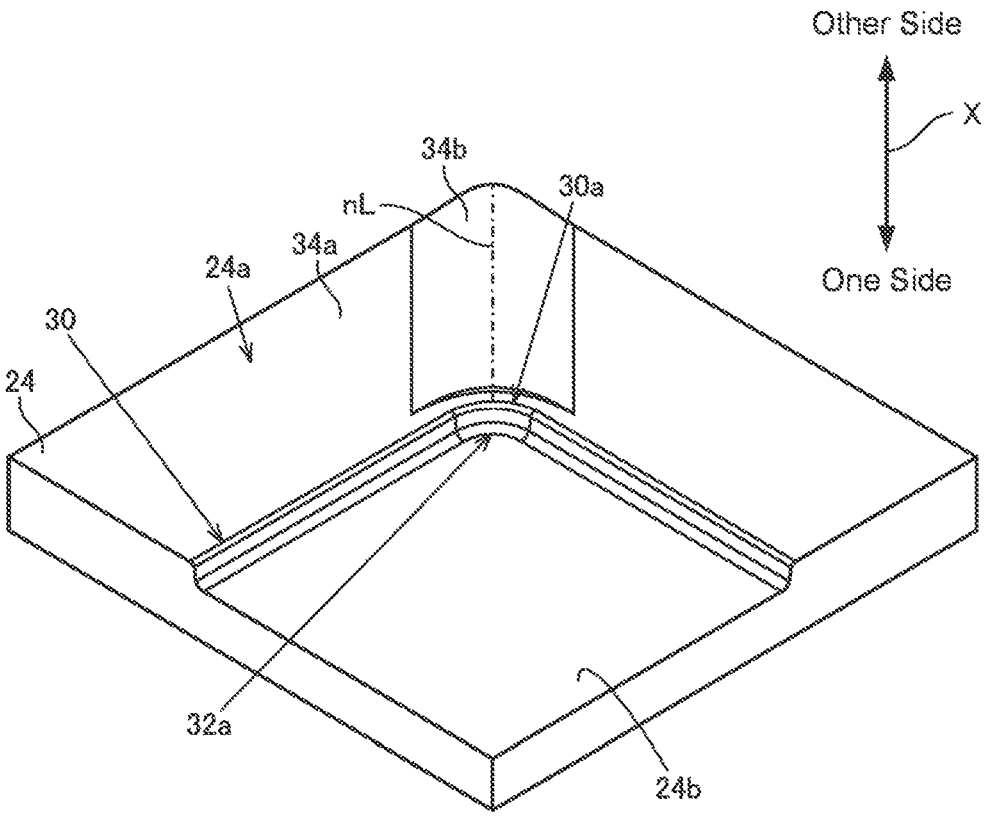
[Figure 26]
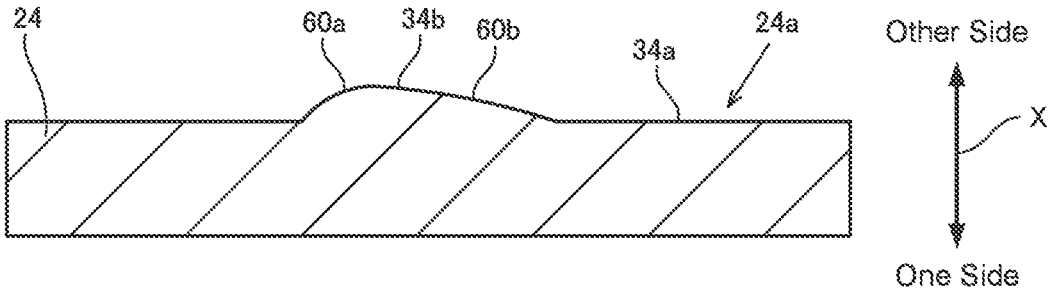

[Figure 27]
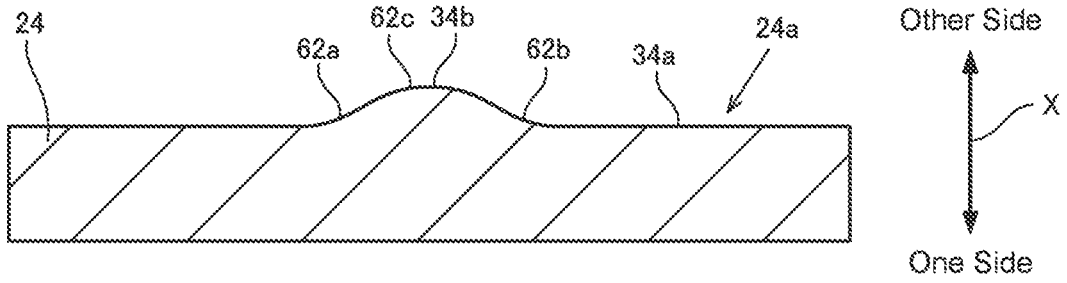
[Figure 28]
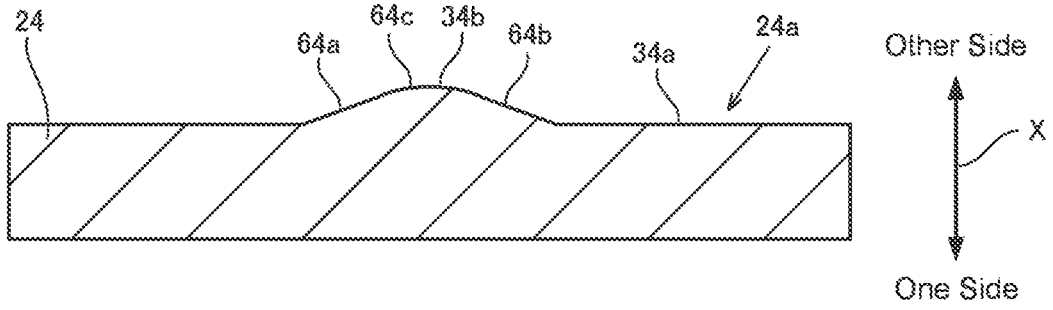
[Figure 29]
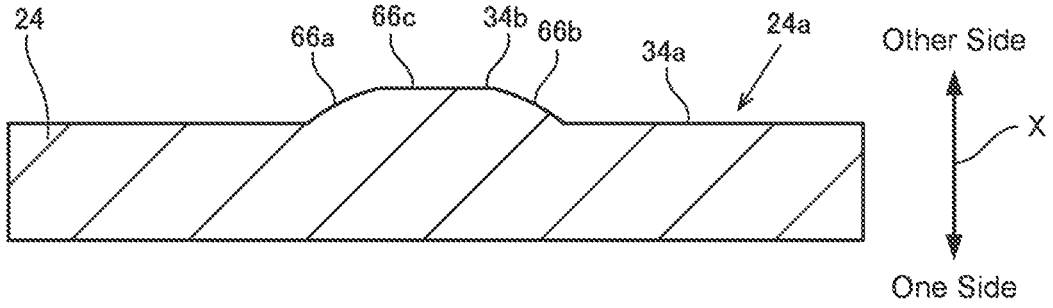

[Figure 30]
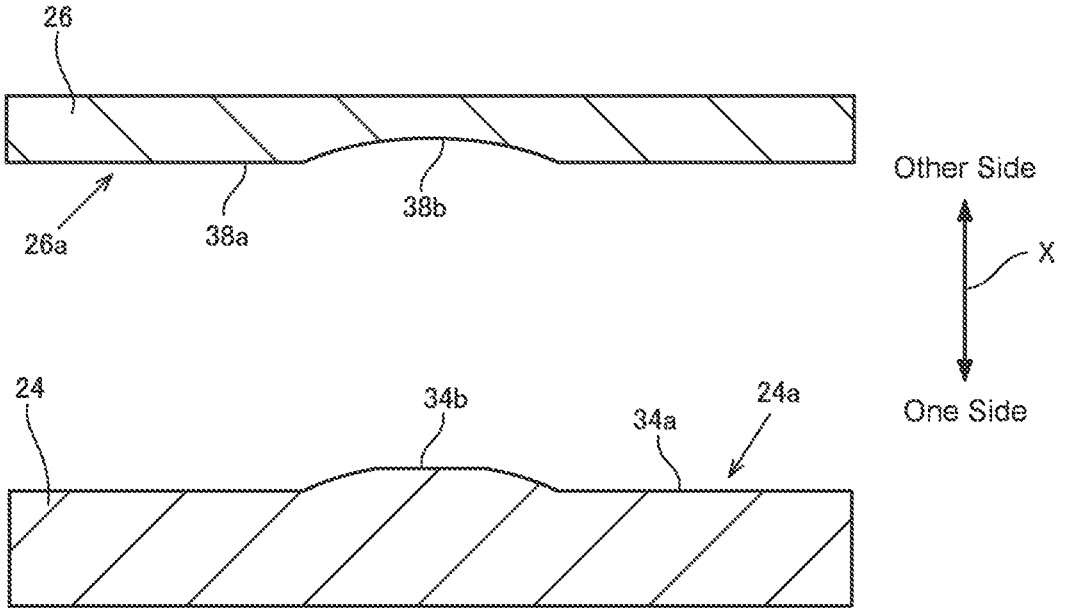
[Figure 31]
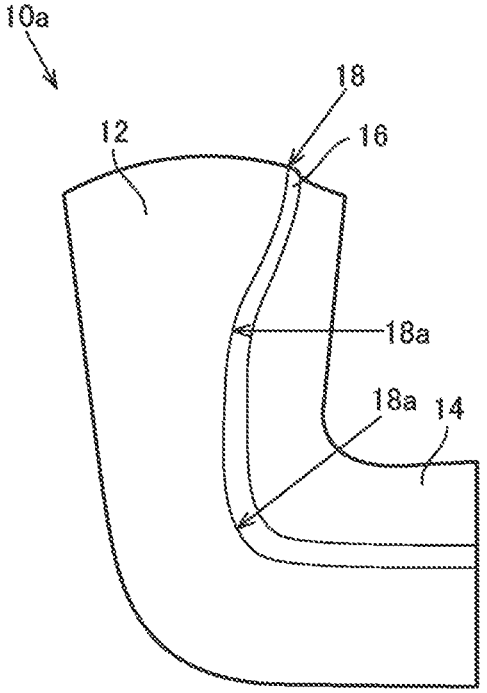

[Figure 32]
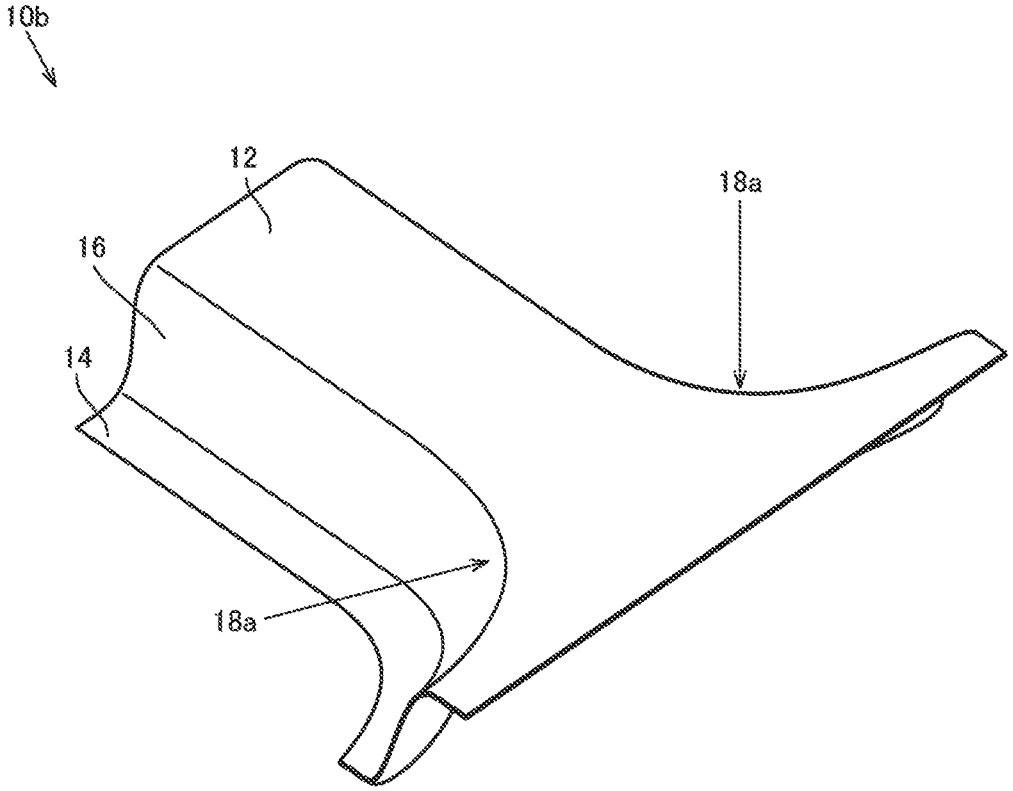

[Figure 33]
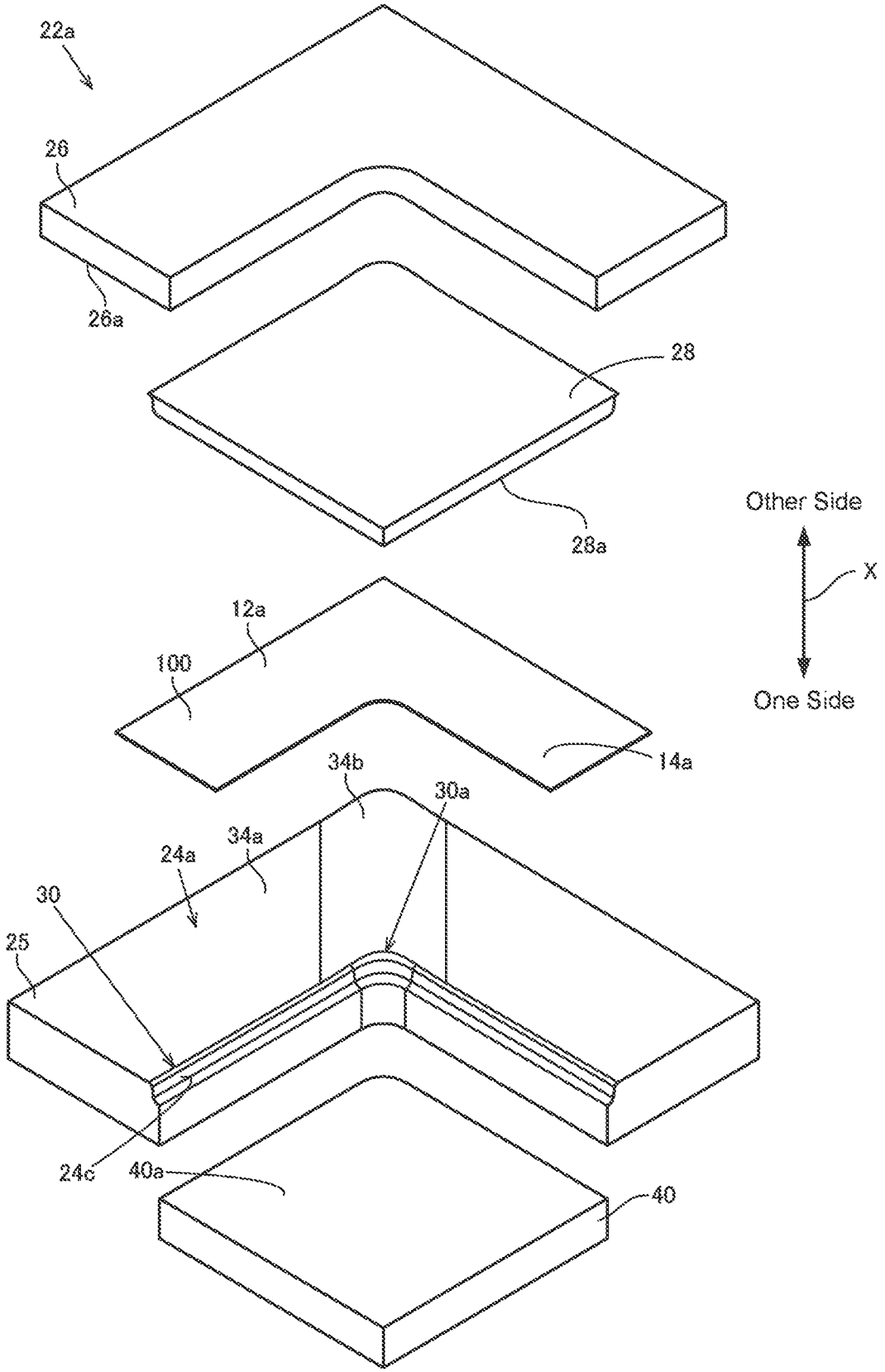

[Figure 34]
(a)
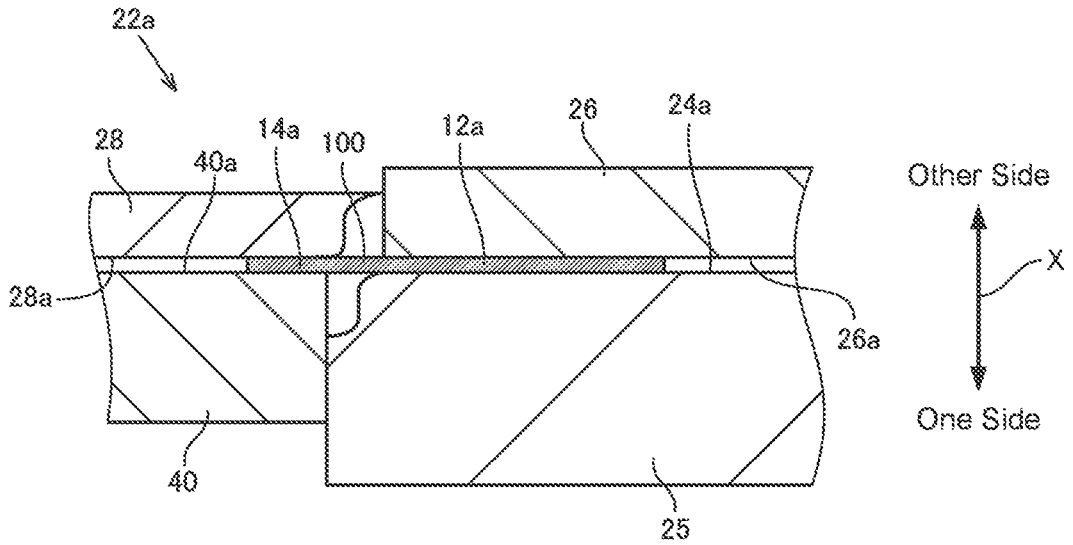
(b)
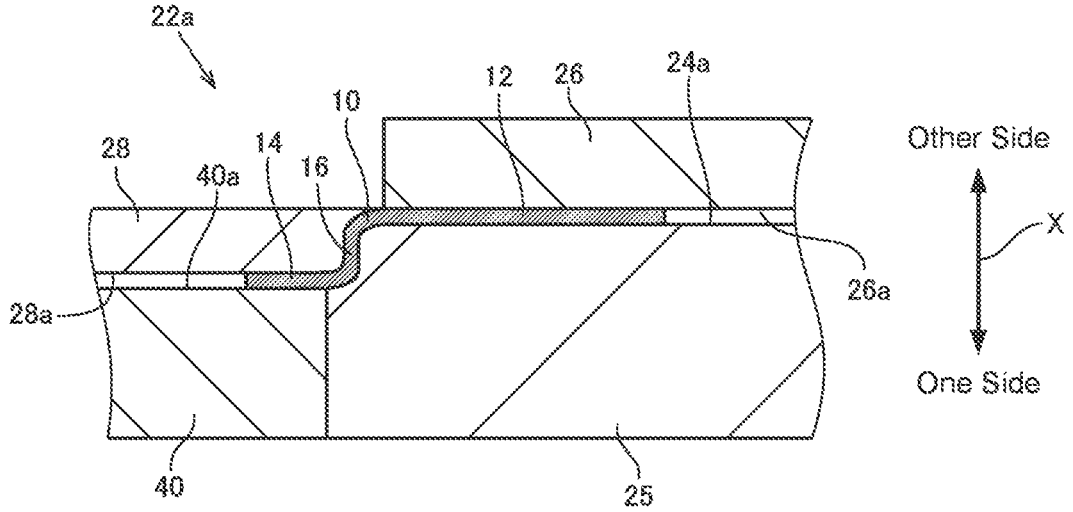

PRESS FORMING METHOD AND PRESS APPARATUS

TECHNICAL FIELD

The present invention relates to a press forming method and a press apparatus.

BACKGROUND ART

A framework structure of an automobile is produced by joining a plurality of framework members obtained by press-forming a blank metal sheet. In recent years, from the viewpoint of reducing the weight of vehicle bodies and improving collision safety, framework members are being made thinner by utilizing ultra-high tension material as a blank metal sheet.

On the other hand, by making framework members (blank metal sheets) thinner as described above, the problem has arisen that the rigidity of the framework members decreases, and wrinkles occur during press forming. Therefore, press forming methods for solving this problem have been proposed.

For example, Patent Document 1 discloses a method in which a pressed component having a top plate part, a vertical wall part and a flange part is press-formed from a blank metal sheet. In the method disclosed in Patent Document 1, press forming is performed in a state in which a portion that will be formed into the top plate part in the pressed component is pressed between a pad and a die, or a state in which a clearance between the pad and the die is maintained at a clearance equivalent to 1.1 times or less the thickness of the blank metal sheet.

LIST OF PRIOR ART DOCUMENTS

Patent Document

Patent Document 1: WO 2011/145679

SUMMARY OF INVENTION

Technical Problem

Patent Document 1 discloses that by performing press forming in the manner described above, during press forming, out-of-plane deformation of a portion to be formed into the top plate part is suppressed, and the occurrence of wrinkles is suppressed. However, during actual operation, due to reasons such as increased strength of the blank metal sheet and the performance of the press apparatus, in some cases the pressurizing force of the pad and the die cannot be sufficiently secured, and the clearance between the pad and the die cannot be appropriately maintained. In such a case, since the portion to be formed into the top plate part cannot be sufficiently restrained, buckling cannot be sufficiently suppressed and the occurrence of wrinkles cannot be sufficiently prevented. Therefore, the probability that formed products in which wrinkles occurred will be produced by press working increases, and as a result the proportion of formed products which are not suitable as products increases. On the other hand, when attempting to ensure the pressurizing force of the pad and the die and maintain the clearance therebetween, it is necessary to provide a higher load, which may lead to an increase in equipment cost and a decrease in the press tooling life. In addition, there is also a need for forming larger components than heretofore using a high-strength steel sheet, by integrating a plurality of components. The pressurizing force is the average interfacial pressure obtained by dividing the load applied to the metal sheet by the area of the contact portion between the pad and the metal sheet, and therefore the larger the component is, the greater the load that will be required to suppress the occurrence of wrinkles is, and the more difficult it will be to secure the pressurizing force.

Therefore, an objective of the present invention is to provide a press forming method and a press apparatus which can suppress the occurrence of wrinkles in a formed product, even in a case where it is difficult to control a distance between a pad and a die.

Solution to Problem

The gist of the present invention is a press forming method and a press apparatus which are described hereunder.

(1) A press forming method in which, assuming a thickness direction of a metal sheet to be a pressing direction, a die is arranged on one side of the metal sheet in the pressing direction, and a pad and a punch are arranged on another side of the metal sheet in the pressing direction, and press forming is performed on the metal sheet by means of the die, the pad and the punch, the method comprising:

a first step of pinching one part of the metal sheet by means of the die and the pad, and a second step of, in a state in which the one part of the metal sheet is pinched by the die and the pad, moving the punch in a direction in which the punch approaches the die in the pressing direction relatively to perform press forming on the metal sheet, wherein:

the die has a first support surface which faces the pad in the pressing direction and which has an edge including a curved portion that curves so as to be recessed in an arc shape as viewed from the pressing direction, and a wall surface extending to the one side in the pressing direction from the edge of the first support surface;

the pad has a second support surface which faces the first support surface in the pressing direction;

the punch is provided on an opposite side to the first support surface with respect to the wall surface as viewed from the pressing direction;

the first support surface includes a first flat portion which extends in an orthogonal direction to the pressing direction, and a first deformation portion which protrudes or is recessed with respect to the first flat portion in the pressing direction;

the second support surface includes a second flat portion which faces the first flat portion in the pressing direction, and a second deformation portion which is recessed or protrudes with respect to the second flat portion so as to correspond to the first deformation portion;

the first deformation portion is provided on a normal line of the curved portion, as viewed from the pressing direction;

the first flat portion is provided continuously on both sides of the first deformation portion in a direction along the curved portion, as viewed from the pressing direction; and when a space between the first deformation portion and the second deformation portion is assumed to be a deformation space, in the second step, press forming is performed so that portions of the metal sheet which are on both sides of the deformation space in the direction along the curved portion as viewed from the pressing direction flow into the deformation space, and the metal sheet deforms along the first deformation portion and the second deformation portion in the deformation space.

(2) The press forming method according to the above (1), wherein the first deformation portion includes at least one part of the curved portion.

(3) The press forming method according to the above (2), wherein a length of a part of the curved portion that is included in the first deformation portion is 0.3 times or more an overall length of the curved portion.

(4) The press forming method according to any one of the above (1) to (3), wherein, in the second step, the metal sheet in the deformation space deforms so as to form a single arc in a cross section orthogonal to the normal line of the curved portion as viewed from the pressing direction.

(5) The press forming method according to any one of the above (1) to (4), wherein, a height or a depth of the first deformation portion with respect to the first flat portion in the pressing direction decreases as the first deformation portion extends away from the curved portion in a direction parallel to the normal line.

(6) The press forming method according to any one of the above (1) to (5), wherein, in a cross section obtained by cutting the die and the metal sheet along a plane parallel to the pressing direction and passing through the normal line, a length of the first deformation portion in a parallel direction to the normal line is 0.1 times or more a length of the one part of the metal sheet that is pinched by the die and the pad in the first step.

(7) The press forming method according to any one of the above (1) to (6), wherein, as viewed from the pressing direction, when a portion at which a curvature of the curved portion exhibits a local maximum value is assumed to be a reference point, the first deformation portion is provided on a normal line of the curved portion at the reference point.

(8) The press forming method according to the above (7), wherein the first deformation portion is provided so as to include the reference point of the curved portion.

(9) The press forming method according to the above (8), wherein, in a cross section of the die that is parallel to the pressing direction and that passes through a tangential line of the curved portion at the reference point, a height or a depth of the first deformation portion with respect to the first flat portion in the pressing direction is 0.0001 times or more a length of the first deformation portion in a direction orthogonal to the pressing direction.

(10) The press forming method according to any one of the above (1) to (9), wherein, before the first step, the metal sheet is subjected to predetermined forming processing.

(11) The press forming method according to any one of the above (1) to (10), wherein:

a holder is further arranged on the one side of the metal sheet in the pressing direction;

in the first step, the metal sheet is further pinched by the punch and the holder; and in the second step, in a state in which the metal sheet is pinched by the punch and the holder, the punch is moved in a direction in which the punch approaches the die in the pressing direction relatively to perform press forming on the metal sheet.

(12) The press forming method according to any one of the above (1) to (11), wherein:

the first deformation portion protrudes with respect to the first flat portion in the pressing direction;

the second deformation portion is recessed with respect to the second flat portion in the pressing direction; and a central portion of the second deformation portion in the direction along the curved portion is curved in a curved surface shape.

(13) The press forming method according to any one of the above (1) to (11), wherein:

the first deformation portion is recessed with respect to the first flat portion in the pressing direction;

the second deformation portion protrudes with respect to the second flat portion in the pressing direction; and a central portion of the first deformation portion in the direction along the curved portion is curved in a curved surface shape.

(14) A press apparatus that includes the die, the pad and the punch used in the press forming method according to any one of the above (1) to (13).

(15) The press apparatus according to the above (14), further including a holder that is arranged so as to face the punch in the pressing direction.

Advantageous Effect of Invention

According to the present invention, the occurrence of wrinkles in a formed product can be suppressed, even in a case where it is difficult to control the distance between a pad and a die.

BRIEF DESCRIPTION OF DRAWINGS

FIG. 1 is a perspective view illustrating an example of a formed product that is produced by utilizing the press forming method according to the present invention.

FIG. 2 is a perspective view illustrating a blank metal sheet and a press apparatus that are used in a press forming method according to a first embodiment of the present invention.

FIG. 3 is a view illustrating a cross section of a die obtained by cutting a portion A-A in FIG. 2 in the pressing direction, and a cross section of a pad obtained by cutting a portion B-B in FIG. 2 in the pressing direction.

FIG. 4 is a view illustrating a cross section of a die obtained by cutting a portion C-C in FIG. 2 in the pressing direction, a cross section of a pad obtained by cutting a portion D-D in FIG. 2 in the pressing direction, and a cross section of a metal sheet obtained by cutting a portion E-E in FIG. 2 in the pressing direction.

FIG. 5 is a view for describing the press forming method.

FIG. 6 is a view for describing the press forming method.

FIG. 7 is a view for describing the press forming method.

FIG. 8 is a view for describing the press forming method.

FIG. 9 is a view for describing a problem during press forming.

FIG. 10 is a view for describing a problem during press forming.

FIG. 11 is view for describing an advantageous effect of the present embodiment.

FIG. 12 is a view illustrating a modification of the die.

FIG. 13 is a view illustrating a modification of the die.

FIG. 14 is a view illustrating a modification of the die.

FIG. 15 is a view illustrating a modification of the die.

FIG. 16 is a view illustrating a modification of the die.
FIG. 17 is a view illustrating a modification of the die.
FIG. 18 is a view illustrating a modification of the die.
FIG. 19 is a view illustrating a modification of the die.
FIG. 20 is a view illustrating a modification of the die.
FIG. 21 is a view illustrating a modification of the die.
FIG. 22 is a view illustrating a modification of the die.
FIG. 23 is a view illustrating a modification of the die.
FIG. 24 is a view illustrating a modification of the die.
FIG. 25 is a view illustrating a modification of the die.
FIG. 26 is a view illustrating a modification of the die.
FIG. 27 is a view illustrating a modification of the die.
FIG. 28 is a view illustrating a modification of the die.
FIG. 29 is a view illustrating a modification of the die.
FIG. 30 is a view illustrating a modification of the die and the pad.
FIG. 31 is a view illustrating another example of a formed product.
FIG. 32 is a view illustrating a further other example of a formed product.
FIG. 33 is a perspective view illustrating a press apparatus that is used in a press forming method according to a second embodiment of the present invention.
FIG. 34 is a view for describing the press forming method according to the second embodiment of the present invention.

DESCRIPTION OF EMBODIMENTS

Hereunder, a press forming method and a press apparatus according to embodiments of the present invention are described while referring to the accompanying drawings.

(Formed Product)

First, a formed product that is produced utilizing the press forming method according to the present invention will be briefly described. FIG. 1 is a perspective view illustrating one example of a formed product produced utilizing the press forming method according to the present invention. Note that, in FIG. 1, the pressing direction when performing press forming on a metal sheet 100 to be described later (see FIG. 2 that is described later) that is used as a starting material is indicated by an arrow X (hereinafter, described as a "pressing direction X"). The pressing direction X is a direction that matches the thickness direction of the metal sheet 100 (see FIG. 2).

As illustrated in FIG. 1, a formed product 10 has a first plate-shaped part 12, a second plate-shaped part 14, and a vertical wall part 16. The first plate-shaped part 12 is formed so as to extend in a direction that is orthogonal to the pressing direction X. In the present embodiment, the second plate-shaped part 14 is also similarly formed so as to extend in a direction that is orthogonal to the pressing direction X. The second plate-shaped part 14 is provided so as to be spaced apart from the first plate-shaped part 12 on one side (in the present embodiment, the downward side) in the pressing direction X. The vertical wall part 16 extends in the pressing direction X and connects the first plate-shaped part 12 and the second plate-shaped part 14.

A curved portion 18*a* that curves so as to be recessed in an arc shape as viewed from a pressing direction X is formed at a boundary part 18 between the first plate-shaped part 12 and the vertical wall part 16. Further, in the present embodiment, a curved portion 20*a* that curves so as to be recessed in an arc shape as viewed from the pressing direction X is also formed at a boundary part 20 between the second plate-shaped part 14 and the vertical wall part 16. In the present embodiment, the boundary parts 18 and 20 each have an L-shape as viewed from the pressing direction X. In the present embodiment, the formed product 10 has an L-shape as viewed from the pressing direction X.

First Embodiment

Next, a press forming method and a press apparatus used in the press forming method according to a first embodiment of the present invention will be described. First, the press apparatus will be described.

(Press Apparatus)

FIG. 2 is a perspective view illustrating a blank metal sheet and a press apparatus that are used in the press forming method according to the first embodiment of the present invention.

As illustrated in FIG. 2, in the press forming method according to the present embodiment, press forming with respect to the L-shaped metal sheet 100 that is the starting material for the formed product 10 is performed by a press apparatus 22. For example, a high-strength steel sheet having a tensile strength of 590 MPa or more, 780 MPa or more, 980 MPa or more, 1180 MPa or more, or furthermore 1500 MPa or more can be used as the metal sheet 100. In the following description, of the entire metal sheet 100, a portion that corresponds to the first plate-shaped part 12 of the formed product 10 is referred to as a "first portion 12*a*", and a portion that corresponds to the second plate-shaped part 14 of the formed product 10 is referred to as a "second portion 14*a*".

Note that, the shape of a metal sheet serving as the starting material is appropriately changed according to the shape of the formed product. Further, although a case where the press forming method according to the present invention is performed on a tabular metal sheet is described hereunder, the press forming method according to the present invention may be performed using a metal sheet subjected to predetermined forming processing as a starting material. Accordingly, after arbitrary press forming processing has been performed on a tabular metal sheet, the press forming method according to the present invention may be performed with respect to the metal sheet in question.

The press apparatus 22 has a die 24, a pad 26 and a punch 28. In the present embodiment, in the pressing direction X, the die 24 is arranged on one side of the metal sheet 100 (in the present embodiment, below the metal sheet 100), and the pad 26 and the punch 28 are arranged on the other side of the metal sheet 100 (in the present embodiment, above the metal sheet 100). As described later, in the present embodiment, by causing the die 24 and the punch 28 to move in directions in which they relatively approach each other in the pressing direction X, the first plate-shaped part 12, the second plate-shaped part 14, and the vertical wall part 16 are formed. Note that, each component (the die 24, the pad 26 and the punch 28) of the press apparatus 22 can be manufactured using the same material as the material of a known press tooling. Further, each component of the press apparatus 22 can be driven by the same kind of drive mechanism (an electric cylinder, a hydraulic cylinder, or a gas cushion apparatus) as the drive mechanism of a known press apparatus.

FIG. 3 is a view illustrating a cross section of the die 24 obtained by cutting a portion A-A in FIG. 2 in the pressing direction X, and a cross section of the pad 26 obtained by cutting a portion B-B in FIG. 2 in the pressing direction X. Further, FIG. 4 is a view illustrating a cross section of the die 24 obtained by cutting a portion C-C in FIG. 2 in the pressing direction X, a cross section of the pad 26 obtained by cutting a portion D-D in FIG. 2 in the pressing direction X, and a cross section of the metal sheet 100 obtained by cutting a portion E-E in FIG. 2 in the pressing direction X.

As illustrated in FIG. 2 to FIG. 4, the die 24 has a support surface 24*a*, a support surface 24*b* and a wall surface 24*c*. The support surface 24*a* has an L-shape as viewed from the pressing direction X. The support surface 24*a* faces the pad 26 in the pressing direction X. The support surface 24*b* has an approximately rectangular shape as viewed from the pressing direction X. The support surface 24*b* is provided on the inner side of the support surface 24*a* and is provided at a position that is further to the one side in the pressing direction X than the support surface 24*a*. The support surface 24*b* faces the punch 28 in the pressing direction X. The wall surface 24*c* has an L-shape as viewed from the pressing direction X. The wall surface 24*c* is provided so as to extend to the one side in the pressing direction X from an edge 30 of the support surface 24*a*. In the present embodiment, the wall surface 24*c* is provided so as to connect the edge 30 of the support surface 24*a* and an edge 32 of the support surface 24*b*.

The edge 30 of the support surface 24*a* includes a curved portion 30*a* that curves so as to be recessed in an arc shape as viewed from the pressing direction X. The edge 30 is provided so as to correspond to the boundary part 18 (see FIG. 1) of the formed product 10. Specifically, the edge 30 is provided so as to have an L-shape as viewed from the pressing direction X. Further, in the present embodiment, the curved portion 30*a* curves in an arc shape so as to correspond to the curved portion 18*a* (see FIG. 1) of the boundary part 18. The curved portion 30*a* is provided on the boundary between the support surface 24*a* and the wall surface 24*c*. In the present embodiment, the support surface 24*a* corresponds to a first support surface.

The support surface 24*a* includes a flat portion 34*a* that extends in an orthogonal direction to the pressing direction X, and a deformation portion 34*b* that protrudes to the other side in the pressing direction X from the flat portion 34*a*. As viewed from the pressing direction X, the flat portion 34*a* is provided continuously on both sides of the deformation portion 34*b* in a direction Y (see FIG. 2; the extending direction of the curved portion 30*a*) along the curved portion 30*a*. In the present embodiment, the flat portion 34*a* corresponds to a first flat portion, and the deformation portion 34*b* corresponds to a first deformation portion. Note that, in the following description, the phrase "direction along the curved portion" means a direction along the curved portion as viewed from the pressing direction.

The deformation portion 34*b* is provided on a normal line at an arbitrary position of the curved portion 30*a* as viewed from the pressing direction X. In the present embodiment, as illustrated in FIG. 2, as viewed from the pressing direction X, when a portion in the curved portion 30*a* at which the curvature exhibits a local maximum value (in the present embodiment, the maximal value) is assumed to be a reference point, the deformation portion 34*b* is provided on a normal line nL (line indicated by a dashed line in FIG. 2) of the curved portion 30*a* at the reference point. Further, in the present embodiment, as viewed from the pressing direction X, the deformation portion 34*b* is formed so as to extend in a parallel direction (normal line direction) to the normal line nL. Note that, in a case where a portion at which the curvature exhibits a local maximum value is continuously present in the curved portion 30*a*, the center point of the continuous portion is adopted as the reference point. Further, in the following description, the phrase "normal line of the curved portion" means a normal line of the curved portion as viewed from the pressing direction. In addition, in the following description, the phrase "curvature of the curved portion" means the curvature of the curved portion as viewed from the pressing direction.

From the viewpoint of sufficiently suppressing the occurrence of wrinkles at the curved portion 18*a* in the formed product 10, the deformation portion 34*b* is preferably provided so as to include at least one part of the curved portion 30*a*. Further, from the viewpoint of reliably suppressing the occurrence of wrinkles at the curved portion 18*a* in the formed product 10, the length of a part of the curved portion 30*a* which is included in the deformation portion 34*b* is preferably 0.3 times or more the overall length of the curved portion 30*a*. In the present embodiment, the deformation portion 34*b* is formed so as to include the reference point of the curved portion 30*a*. In this case, the occurrence of wrinkles in the vicinity of the central portion of the curved portion 18*a* (a portion at which wrinkles are liable to occur) in the formed product 10 can be sufficiently suppressed. In the present embodiment, the deformation portion 34*b* is provided so as to include the entire curved portion 30*a*. Note that, in the present embodiment, for example, a portion that has a curvature of 1% or more with respect to the curvature of the aforementioned reference point and is continuous therewith is defined as the curved portion 30*a*, and the length of the curved portion 30*a* is defined. Specifically, for example, as viewed from the pressing direction X, in a case where the radius of curvature of the curved portion 30*a* at the reference point is 50 mm, a portion having a radius of curvature of 5000 mm or less that is continuous with the reference point is defined as the curved portion.

Referring to FIG. 3, in an arbitrary cross section of the die 24 parallel to the pressing direction X and parallel to a tangential line tL of the curved portion 30*a* (line indicated by the chain double-dashed line in FIG. 2) at the reference point, a height H of the deformation portion 34*b* with respect to the flat portion 34*a* in the pressing direction X, a length L of the deformation portion 34*b* in the orthogonal direction to the pressing direction X, and a radius of curvature R of the deformation portion 34*b* are appropriately set according to the tensile strength of the metal sheet 100 and the like. In the present embodiment, of the entire deformation portion 34*b*, in a region that faces the metal sheet 100 in the pressing direction X, the height H is preferably set to, for example, 0.0001 times or more the value of the length L. Further, of the entire deformation portion 34*b*, in a region that faces the metal sheet 100 in the pressing direction X, the radius of curvature R is preferably set, for example, to 1,000 mm or more and 10,000 mm or less, and more preferably is set to 2,000 mm or more and 5,000 mm or less. Note that, when viewed from the pressing direction X, the tangential line tL is a tangential line of the curved portion 30*a* at the reference point.

In the present embodiment, in a cross section of the die 24 that is parallel to the pressing direction X and passes through the tangential line tL (a cross section obtained by cutting the die 24 in the pressing direction X along the tangential line tL), the height H is preferably set to 0.0001 times or more the length L. Further, the radius of curvature R is preferably set to, for example, 1,000 mm or more and 10,000 mm or less, and more preferably is set to 2,000 mm or more and 5,000 mm or less.

Note that, although a detailed description is omitted herein, the depth in the pressing direction X of a deformation portion 38*b* with respect to a flat portion 38*a* to be described later is set in a similar manner to the height H of the deformation portion 34*b*. Further, a length in an orthogonal direction to the pressing direction X and a radius of curvature of the deformation portion 38*b* are also set in a similar manner to the length L and the radius of curvature R of the deformation portion 34*b*.

Referring to FIG. 4, in a cross section obtained by cutting the die 24 and the metal sheet 100 along a plane parallel to the pressing direction X and passing through a normal line at an arbitrary position of the curved portion 30*a* (a cross section obtained by cutting the die 24 and the metal sheet 100 in the pressing direction X along the normal line), the length of the deformation portion 34*b* in the direction parallel to the normal line is preferably set to 0.1 times or more the length of the first portion 12*a* in the direction parallel to the normal line. In this case, the occurrence of wrinkles can be suppressed in a sufficient region around the curved portion 18*a* in the formed product 10. In the present embodiment, in a cross section obtained by cutting the die 24 and the metal sheet 100 along a plane parallel to the pressing direction X and passing through the normal line nL (a cross section obtained by cutting the die 24 and the metal sheet 100 in the pressing direction X along the normal line nL), a length L1 of the deformation portion 34*b* in the direction parallel to the normal line nL is set to 0.1 times or more a length L2 of the first portion 12*a* in the direction parallel to the normal line nL. In the present embodiment, the length L1 is set to the value of the length L2 or more. Note that, in a first step to be described later, the first portion 12*a* is a portion that is pinched by the die 24 and the pad 26.

As illustrated in FIG. 2, in the present embodiment, the support surface 24*b* of the die 24 is a flat surface extending in a direction orthogonal to the pressing direction X. The edge 32 of the support surface 24*b* is provided so as to correspond to the boundary part 20 (see FIG. 1) of the formed product 10. Specifically, the edge 32 is provided so as to have an L-shape as viewed from the pressing direction X, and includes a curved portion 32*a* that curves so as to be recessed in an arc shape as viewed from the pressing direction X. In the present embodiment, the curved portion 32*a* curves in an arc shape so as to correspond to the curved portion 20*a* (see FIG. 1) of the boundary part 20. The curved portion 32*a* is provided on the boundary between the support surface 24*b* and the wall surface 24*c*.

Referring to FIG. 2 to FIG. 4, an undersurface 26*a* of the pad 26 faces the support surface 24*a* of the die 24 in the pressing direction X. The undersurface 26*a* has an edge 36 which is provided so as to correspond to the boundary part 18 (see FIG. 1) of the formed product 10. The edge 36 includes a curved portion 36*a* that curves so as to be recessed in an arc shape as viewed from the pressing direction X. In the present embodiment, the curved portion 36*a* curves in an arc shape so as to correspond to the curved portion 18*a* (see FIG. 1) of the boundary part 18. In the present embodiment, the undersurface 26*a* corresponds to a second support surface.

The undersurface 26*a* of the pad 26 includes the flat portion 38*a* which faces the flat portion 34*a* in the pressing direction X, and the deformation portion 38*b* which is recessed with respect to the flat portion 38*a* so as to correspond to the deformation portion 34*b*. In the present embodiment, the deformation portion 38*b* is formed so as to be recessed toward the other side in the pressing direction X from the flat portion 38*a*. The deformation portion 38*b* is provided so as to face the deformation portion 34*b* in the pressing direction X. More specifically, the deformation portion 34*b* and the deformation portion 38*b* are formed so that they can be fitted to each other. Note that, a central portion of the deformation portion 38*b* in the direction Y along the curved portion 30*a* is preferably curved in a curved surface shape so as to be convex toward the other side in the pressing direction X. In the present embodiment, as illustrated in FIG. 3, in an arbitrary cross section of the die 24 that is parallel to the pressing direction X and parallel to the tangential line tL (see FIG. 2), the entire deformation portion 38*b* is curved in a curved surface shape. In the present embodiment, the flat portion 38*a* corresponds to a second flat portion, and the deformation portion 38*b* corresponds to a second deformation portion.

Referring to FIG. 2, the punch 28 is provided on the opposite side to the support surface 24*a* with respect to the wall surface 24*c* as viewed from the pressing direction X. In the present embodiment, the punch 28 is provided so that an undersurface 28*a* of the punch 28 faces the support surface 24*b* of the die 24 in the pressing direction X.

(Press Forming Method)

Next, a press forming method that uses the aforementioned press apparatus 22 will be described. When performing press forming on the metal sheet 100 using the press apparatus 22, as illustrated in FIG. 5, first the metal sheet 100 is placed on the support surface 24*a* of the die 24.

Next, as illustrated in FIG. 6, one part (in the present embodiment, the first portion 12*a*) of the metal sheet 100 is pinched between the support surface 24*a* of the die 24 and the undersurface 26*a* of the pad 26 (first step). FIG. 7 is a cross-sectional view illustrating the relation between the die 24, the pad 26 and the metal sheet 100 in the first step. Note that, in FIG. 7, a cross section orthogonal to the normal line nL of the curved portion 30*a* is illustrated. The same also applies to FIG. 11 that is described later.

As illustrated in FIG. 7, in the present embodiment, in the first step the portion of the metal sheet 100 which is pinched by the deformation portion 34*b* of the die 24 and the deformation portion 38*b* of the pad 26 curves along the shape of the deformation portion 34*b* and the deformation portion 38*b*. Specifically, the portion of the metal sheet 100 which is pinched by the deformation portion 34*b* and the deformation portion 38*b* deforms so as to form a single arc. Note that, the distance (pad clearance) between the support surface 24*a* of the die 24 and the undersurface 26*a* of the pad 26 in the pressing direction X is preferably set to be 1.00 times the thickness of the metal sheet 100. However, an extremely high pad load is required in order to set the aforementioned pad clearance to 1.00 times the thickness of the metal sheet 100, and at the time of actual operation it is difficult to set the pad clearance to 1.00 times the thickness of the metal sheet 100. In the present embodiment, in the first step the distance (pad clearance) between the support surface 24*a* of the die 24 and the undersurface 26*a* of the pad 26 in the pressing direction X is, for example, preferably set to 1.50 times or less the thickness of the metal sheet 100, and more preferably is set to 1.10 times or less the thickness of the metal sheet 100. Hereunder, the space between the deformation portion 34*b* and the deformation portion 38*b* is referred to as a "deformation space 11". In the present embodiment, the portion of the metal sheet 100 that is located within the deformation space 11 deforms so as to form a single arc in the first step.

In a state in which the first portion 12*a* of the metal sheet 100 is pinched between the die 24 and the pad 26 as described above, the punch 28 (undersurface 28*a*) is moved in a direction in which the punch 28 (undersurface 28*a*) approaches the die 24 (support surface 24*a*) relatively in the pressing direction X (second step). By this means, as illustrated in FIG. 8, press forming is performed on the metal sheet 100, and the formed product 10 is obtained. Finally, the pad 26 and the punch 28 are moved to the other side in the pressing direction X relatively with respect to the support surface 24*a* of the die 24, and the formed product 10 is taken out.

Note that, in a case of forming the formed product 10 using the metal sheet 100 having a tensile strength within the range from 200 MPa to 1600 MPa that is generally used for automobile components and the like, if the metal sheet 100 is pressed with a pressure of 30 MPa or more by the pad 26, there is a risk that a crack will occur in the vicinity of the curved portion 20*a* in the formed product 10. On the other hand, if the metal sheet 100 is pressed with a pressure of 0.1 MPa or less by the pad 26, there is a risk that it will not be possible to sufficiently suppress out-of-plane deformation of the first plate-shaped part 12. Therefore, it is desirable that the pressing by the pad 26 be performed with a pressure that is 0.1 MPa or more and 30 MPa or less.

Note that, the pressure applied from the pad 26 to the metal sheet 100 is an average interfacial pressure that is obtained by dividing the load applied to the metal sheet 100 from the pad 26 by the area of the contact portion between the pad 26 and the metal sheet 100. Therefore, the larger the component is, the greater the pad load that is required is.

In the present embodiment, in the second step, as illustrated by dashed-line arrows in FIG. 8, in-plane bending toward the punch 28 side acts on the first portion 12*a* of the metal sheet 100. Thus, as illustrated by chain double-dashed line arrows in FIG. 8, portions of the first portion 12*a* which are in the vicinity of the curved portion 30*a* (see FIG. 2) of the die 24 and which are on both sides of the deformation space 11 in the direction Y along the curved portion 30*a* flow into the deformation space 11. As a result, a force in the compressing direction acts on the metal sheet 100 in the deformation space 11.

With regard to the aforementioned point, for example, even in a case where press forming is performed in a state in which the portions of the first portion 12*a* of the metal sheet 100 which are in the vicinity of the curved portion 30*a* are pinched by flat surfaces 50*a* and 50*b* as illustrated in FIG. 9, the material flows in the same manner. Thus, a force in the compressing direction acts on the portions of the first portion 12*a* which are in the vicinity of the curved portion 30*a*. Therefore, unless the pressurizing force of the flat surfaces 50*a* and 50*b* can be sufficiently secured, a clearance between the flat surfaces 50*a* and 50*b* cannot be appropriately maintained. In this case, as illustrated in FIG. 9, the portions of the first portion 12*a* which are in the vicinity of the curved portion 30*a* cannot be appropriately pressed by the flat surfaces 50*a* and 50*b*, and the occurrence of buckling cannot be sufficiently suppressed. As a result, as illustrated by broken lines in FIG. 10, wrinkles are liable to occur at a portion in the vicinity of the curved portion 18*a* in the first plate-shaped part 12 of the formed product 10.

On the other hand, in the present embodiment, as illustrated in FIG. 7, in the deformation space 11 the metal sheet 100 is pinched by the deformation portion 34*b* of the support surface 24*a* of the die 24 and the deformation portion 38*b* of the undersurface 26*a* of the pad 26. Therefore, in the second step, even if a pressurizing force of the support surface 24*a* of the die 24 and the undersurface 26*a* of the pad 26 cannot be sufficiently secured, as illustrated in FIG. 11, in the deformation space 11 the metal sheet 100 can be deformed along the deformation portion 34*b* and the deformation portion 38*b*. In the present embodiment, in the deformation space 11, the metal sheet 100 can be gradually curved so as to form a single arc.

Further, in the present embodiment, in the second step, upon the metal sheet 100 flowing into the deformation space 11 from both sides of the deformation space 11, the metal sheet 100 inside the deformation space 11 is first bent so as to be convex to the other side in the pressing direction X by the deformation portion 34*b*. The portion that has been bent is then pressed to the one side in the pressing direction X by the deformation portion 38*b*. Therefore, in the present embodiment, even if the clearance between the support surface 24*a* of the die 24 and the undersurface 26*a* of the pad 26 cannot be made sufficiently small, because the metal sheet 100 bends as described above in the deformation space 11, the region of the metal sheet 100 that is inside the deformation space 11 as well as portions surrounding that region are appropriately pressed by the support surface 24*a* and the undersurface 26*a*. By this means, in the present embodiment, even without exactly adjusting the pressurizing force of the support surface 24*a* and the undersurface 26*a* and the clearance between the support surface 24*a* and the undersurface 26*a*, a sufficient pad load can be applied to the first portion 12*a* of the metal sheet 100. Thus, according to the present embodiment, by causing the metal sheet 100 to curve in the deformation space 11, even in a case where it is difficult to control the distance between the die 24 and the pad 26, it is possible to apply a sufficient pad load to the metal sheet 100. As a result, the occurrence of wrinkles in the first plate-shaped part 12 in the formed product 10 can be suppressed.

Note that, it is preferable that the central portion of the deformation portion 38*b* in the direction Y along the curved portion 30*a* is curved in a curved surface shape so as to be convex toward the other side in the pressing direction X. By this means, the metal sheet 100 can be caused to gradually curve more reliably in the deformation space 11, and the metal sheet 100 can be sufficiently prevented from deforming in a wavy manner. In the present embodiment, in a cross section that is parallel to the pressing direction X and parallel to the tangential line tL of the curved portion 30*a*, the central portion of the deformation portion 38*b* is curved in a curved surface shape so as to be convex toward the other side in the pressing direction X.

Note that, in the present embodiment, the deformation portion 34*b* is provided on the normal line nL of the curved portion 30*a*. In this case, the metal sheet 100 can be caused to deform in the manner described above at a position at which the inflow amount of the metal sheet 100 is liable to be large between the die 24 and the pad 26. By this means, the occurrence of wrinkles can be sufficiently suppressed at the position at which the inflow amount of the metal sheet 100 is liable to be large between the die 24 and the pad 26.

(Modifications)

Note that, as illustrated in FIG. 4, although in the foregoing embodiment the height of the deformation portion 34*b* with respect to the flat portion 34*a* in the pressing direction X is uniform in the direction parallel to the normal line nL (see FIG. 2), the height of the deformation portion 34*b* may change according to the position thereof in the direction parallel to the normal line nL. Specifically, for example, as illustrated in FIG. 12, the height of the deformation portion 34*b* with respect to the flat portion 34*a* in the pressing direction X may increase as the deformation portion 34*b* extends away from the curved portion 30*a* in the direction parallel to the normal line nL (see FIG. 2). Further, as illustrated in FIG. 13 and FIG. 14, the height of the deformation portion 34*b* with respect to the flat portion 34*a* in the pressing direction X may decrease as the deformation portion 34*b* extends away from the curved portion 30*a* in the direction parallel to the normal line nL (see FIG. 2). Note that, in consideration of the fact that wrinkles easily occur at a portion in the vicinity of the curved portion 18*a* in the first plate-shaped part 12 (see FIG. 10) as described above, preferably the height of the deformation portion 34*b* at the portion in the vicinity of the curved portion 30*a* is enlarged, as illustrated in FIG. 13 and FIG. 14.

Further, although in the foregoing embodiment, as illustrated in FIG. 2, the deformation portion 34*b* is formed so that, as viewed from the pressing direction X, the deformation portion 34*b* transverses the die 24 along the normal line nL with a width that is wider than the curved portion 30*a* and is uniform, the formation region of the deformation portion 34*b* is not limited to the above example. For example, as illustrated in FIG. 15, as viewed from the pressing direction X, the width of the deformation portion 34*b* may be less than the width of the curved portion 30*a*. Further, as illustrated in FIG. 16 to FIG. 21, as viewed from the pressing direction X, the width of the deformation portion 34*b* may change according to the position thereof in the direction parallel to the normal line nL. Furthermore, as illustrated in FIG. 22 to FIG. 24, a configuration may be adopted in which the deformation portion 34*b* is formed only in a predetermined region in the vicinity of the curved portion 30*a*. Further, as illustrated in FIG. 25, the deformation portion 34*b* may be provided so as to be spaced apart from the curved portion 30*a*. However, in this case, the distance between the deformation portion 34*b* and the curved portion 30*a* is, for example, preferably set to a distance that is three times or less the thickness of the metal sheet 100.

Further, although in the foregoing embodiment, as illustrated in FIG. 3, the deformation portion 34*b* is curved with a predetermined radius of curvature R in a cross section parallel to the pressing direction X and parallel to the tangential line tL of the curved portion 30*a*, the shape (contour) of the deformation portion 34*b* is not limited to the above example. For example, as illustrated in FIG. 26, in a cross section parallel to the pressing direction X and parallel to the tangential line tL (see FIG. 2) of the curved portion 30*a* (see FIG. 2), the deformation portion 34*b* may have two curved portions 60*a* and 60*b* that curve with different radii of curvature to each other. In addition, as illustrated in FIG. 27, in a cross section parallel to the pressing direction X and parallel to the tangential line tL (see FIG. 2) of the curved portion 30*a* (see FIG. 2), the deformation portion 34*b* may have curved portions 62*a* and 62*b* that curve so as to be convex to the one side in the pressing direction X, and a curved portion 62*c* that curves so as to be convex to the other side in the pressing direction X. Note that, the deformation portion 34*b* illustrated in FIG. 27 is, as a whole, convex to the other side in the pressing direction X.

Furthermore, for example, as illustrated in FIG. 28, in a cross section parallel to the pressing direction X and parallel to the tangential line tL (see FIG. 2) of the curved portion 30*a* (see FIG. 2), the deformation portion 34*b* may have flat surface portions 64*a* and 64*b* and a curved portion 64*c*. Further, as illustrated in FIG. 29, in a cross section parallel to the pressing direction X and parallel to the tangential line tL (see FIG. 2) of the curved portion 30*a* (see FIG. 2), the deformation portion 34*b* may have curved portions 66*a* and 66*b* and a flat surface portion 66*c*. Note that, the deformation portion 34*b* may be configured so that the deformation portion 34*b* can bend the metal sheet 100 in the deformation space 11 (see FIG. 11) so as to be convex to the other side in the pressing direction X. Accordingly, the deformation portion 34*b* may be constituted by a plurality of protruding portions. Specifically, the aforementioned deformation portion 34*b* may be separated into two parts by forming a groove at the central portion in the direction Y (see FIG. 2) along the curved portion 30*a* in the deformation portion 34*b*.

Further, although a detailed description is omitted herein, the shape of the deformation portion 38*b* can be appropriately changed so as to correspond to the respective shapes of the deformation portion 34*b* illustrated in FIG. 12 to FIG. 29. Note that, it suffices that the deformation portion 34*b* and the deformation portion 38*b* have shapes that correspond in a manner such that the deformation portion 34*b* and the deformation portion 38*b* can be fitted to each other. Accordingly, as illustrated in FIG. 30, the deformation portion 34*b* and the deformation portion 38*b* may have a different shape to each other.

Furthermore, although in the foregoing embodiment, in the pressing direction X, the deformation portion 34*b* is formed so as to protrude with respect to the flat portion 34*a*, and the deformation portion 38*b* is formed so as to be recessed with respect to the flat portion 38*a*, the deformation portion 34*b* may be formed so as to be recessed with respect to the flat portion 34*a*, and the deformation portion 38*b* may be formed so to protrude with respect to the flat portion 38*a*. In this case also, the dimensions (height in the pressing direction X, length in the direction orthogonal to the pressing direction X, and radius of curvature) and shape of each deformation portion can be set similarly to the dimensions and shape of the deformation portions 34*b* and 38*b* described above. Note that, in the case of making the deformation portion 34*b* recessed with respect to the flat portion 34*a*, the central portion of the deformation portion 34*b* in the direction Y along the curved portion 30*a* is preferably curved in a curved surface shape so as to be convex toward the one side in the pressing direction X.

Note that, although in the foregoing embodiment a case of producing the formed product 10 having an L-shape as viewed from the pressing direction X has been described, the press forming method according to the present invention can be favorably utilized when producing various kinds of formed products having a curved portion which, as viewed from the pressing direction, curves in a concave shape at a boundary part between a first plate-shaped part and a vertical wall part.

FIG. 31 is a view illustrating another example of a formed product that is produced by the press forming method according to the present invention. Note that, FIG. 31 is a view illustrating the formed product as viewed from the pressing direction.

Although a detailed description is omitted herein, similarly to the formed product 10 described above, a formed product 10*a* illustrated in FIG. 31 has the first plate-shaped part 12, the second plate-shaped part 14 and the vertical wall part 16. A plurality of curved portions 18*a* which curve in a concave shape (arc shape) as viewed from the pressing direction are formed at the boundary part 18 between the first plate-shaped part 12 and the vertical wall part 16. Although diagrammatic representation is omitted from the drawing, in the press apparatus for producing the formed product 10*a*, it suffices to provide a plurality of first deformation portions in a first support surface of the die and to provide a plurality of second deformation portions in a second support surface of the pad so as to correspond to the plurality of curved portions 18*a*. By this means, the occurrence of wrinkles can be suppressed at portions of the first plate-shaped part 12 that are in the vicinity of the respective curved portions 18*a*.

Furthermore, although a detailed description is omitted herein, the press forming method according to the present invention can also be utilized when producing a formed product 10*b* having a T-shape as viewed from the pressing direction as illustrated in FIG. 32. Note that, the formed product 10*b* has a hat-shaped cross section. Although diagrammatic representation is omitted from the drawing, in the press apparatus for producing the formed product 10*b*, it suffices to provide a first deformation portion in a first support surface of the die and to provide a second deformation portion in a second support surface of the pad so as to correspond to the curved portion 18*a*.

Further, although diagrammatic representation is omitted from the drawings, the press forming method according to the present invention can also be utilized when producing a formed product having a Y-shape or a U-shape as viewed from the pressing direction. In addition, the press forming method according to the present invention can also be utilized for various kinds of draw forming such as cylinder drawing and square cylinder drawing. Note that, when utilizing the present invention for cylinder drawing, it is preferable to, for example, identify in advance a region at which wrinkles are liable to occur in a portion that will be a flange part (first plate-shaped part) in the formed product, and provide a deformation portion so as to correspond to the identified region.

Further, although a case in which the support surface 24*a* of the die 24 has the flat portion 34*a* and the deformation portion 34*b* is described in the foregoing embodiment, the support surface 24*a* may also have another deformation portion in addition to the deformation portion 34*b*. Although diagrammatic representation is omitted from the drawings, for example, in order to form a bead or a bearing surface shape or the like in the first plate-shaped part 12 (see FIG. 1), in addition to the deformation portion 34*b*, another deformation portion that is recessed toward the one side or protrudes toward the other side in the pressing direction X from the flat portion 34*a* may be provided in the support surface 24*a*. Although a detailed description is omitted, the same applies to the undersurface 26*a* of the pad 26.

(Study by Simulation)

In order to confirm the advantageous effect of the present invention, the present inventors evaluated the occurrence state of wrinkles which occur at a portion in the vicinity of the curved portion 18*a* (see FIG. 1) in a formed product by numerical analysis (press forming analysis). Specifically, a case of producing an L-shaped formed product as illustrated in FIG. 1 by means of the press apparatus 22 having the shape illustrated in FIG. 2 was assumed, and numerical analysis by the finite element method was performed (Inventive Examples 1 and 2 of the present invention). Note that, the length L (see FIG. 3) of the deformation portion 34*b* was set to 300 mm, and the radius of curvature R of the deformation portion 34*b* was set to 3000 mm (Inventive Example 1 of the present invention) and 2000 mm (Inventive Example 2 of the present invention). Further, numerical analysis was similarly performed with respect to a case of producing a formed product using the die 24 illustrated in FIG. 25 instead of the die 24 illustrated in FIG. 2 (Inventive Example 3 of the present invention). The radius of curvature R of the deformation portion 34*b* was set to 3000 mm. In addition, as a Comparative Example, a case of producing a formed product by means of a press apparatus having the same configuration as the press apparatus 22 except that the whole area of the support surface 24*a* of the die 24 and the whole area of the undersurface 26*a* of the pad 26 were flat surfaces was assumed, and numerical analysis by the finite element method was performed. A 1180 MPa-class cold-rolled steel sheet (thickness: 1.0 mm) was assumed as the blank metal sheet.

Note that, in a first analysis, the load of the pad 26 (pad load) was changed, and numerical analysis was performed for each pad load. The pad load was set to 7 tonf, 10 tonf and 30 tonf, respectively. Note that, with respect to Inventive Example 3 of the present invention, analysis was not performed for cases where the pad load was 10 tonf and 30 tonf. In a second analysis, the distance (pad clearance) between the support surface 24*a* and the undersurface 26*a* was changed, and numerical analysis was performed for each pad clearance. The pad clearance was set to a clearance equivalent to 1.00 times, 1.03 times, 1.05 times and 1.10 times the thickness of the blank metal sheet, respectively. Note that, the second analysis was not performed with respect to Inventive Example 3 of the present invention. Evaluation results obtained by the first analysis are shown in Table 1, and evaluation results obtained by the second analysis are shown in Table 2. Note that, in the evaluation results shown in Table 1, the amount of wrinkles that occurred at the portion in the vicinity of the curved portion 18*a* is described in ascending order in the form of A, B and C. Similarly, in the evaluation results shown in Table 2, the amount of wrinkles that occurred at the portion in the vicinity of the curved portion 18*a* is described in ascending order in the form of A and B.

TABLE 1

(First Analysis)

| | Radius of Curvature (mm) | Pad Load (tonf) 7 | 10 | 30 |
|---|---|---|---|---|
| Inventive Example 1 | 3000 | A | A | A |
| Inventive Example 2 | 2000 | A | A | A |
| Inventive Example 3 | 3000 | B | — | — |
| Comparative Example | — | C | C | A |

TABLE 2

(Second Analysis)

| | Radius of Curvature (mm) | Pad Clearance(mm) 1.00 t | 1.03 t | 1.05 t | 1.10 t |
|---|---|---|---|---|---|
| Inventive Example 1 | 3000 | A | A | A | A |
| Inventive Example 2 | 2000 | A | A | A | A |
| Comparative Example | — | A | B | B | B |

* "t" in the pad clearance column denotes the thickness (mm) of the blank metal sheet.

Referring to Tables 1 and 2, the occurrence of wrinkles could be suppressed to a certain extent in the Comparative Example also. However, the amount of wrinkles that occurred was smaller in Inventive Examples 1 to 3 of the present invention. In particular, in Inventive Examples 1 and 2 of the present invention, almost no wrinkles occurred, even when the pad load was decreased. Further, in Inventive Examples 1 and 2 of the present invention, even without strictly managing the pad clearance, almost no wrinkles occurred. Note that, in the Comparative Example, even though the same B evaluation was obtained as the result, the amount of wrinkles that occurred increased as the pad clearance increased.

In other words, it is considered that, in actual operations, if an apparatus such as that of the Comparative Example is used, a large number of formed products in which wrinkles have occurred will be produced, and it is considered that by using an apparatus such as that of the Inventive Examples of the present invention, the probability of producing a formed product in which wrinkles have occurred will be extremely low, and stable production can be expected and the production efficiency as a product increases. Further, since it is difficult for wrinkles to occur even if the pad load is small, it is considered that it is easy to support the forming of large-sized components.

Second Embodiment

Although in the foregoing embodiment a case is described in which press forming is performed on the metal sheet 100 using the press apparatus 22 including the die 24, the pad 26 and the punch 28, the configuration of the press apparatus is not limited to the example described above.

FIG. 33 is a perspective view illustrating a press apparatus that is used in a press forming method according to a second embodiment of the present invention.

As illustrated in FIG. 33, in the press forming method according to the present embodiment, press forming is performed on the metal sheet 100 by a press apparatus 22*a*. The press apparatus 22*a* differs from the press apparatus 22 in that the press apparatus 22*a* includes a die 25 instead of the die 24, and also includes a holder 40.

The die 25 has an L-shape in plan view. Similarly to the die 24, the die 25 has the support surface 24*a* including the flat portion 34*a* and the deformation portion 34*b*, and the wall surface 24*c*. Further, similarly to the die 24, the edge 30 of the support surface 24*a* has the curved portion 30*a*. Note that, the support surface 24*b* (see FIG. 2) described above is not provided in the die 25.

The holder 40 is provided on the one side of the metal sheet 100 in the pressing direction X. A top surface 40*a* of the holder 40 faces the second portion 14*a* of the metal sheet 100 in the pressing direction X.

As illustrated in FIG. 34(*a*), in the press forming method according to the present embodiment also, similarly to the press forming method described above, first, the metal sheet 100 is placed on the support surface 24*a* of the die 25, and the first portion 12*a* of the metal sheet 100 is pinched by the support surface 24*a* of the die 25 and the undersurface 26*a* of the pad 26 (first step). In addition, in the present embodiment, in the first step, the second portion 14*a* of the metal sheet 100 is pinched by the undersurface 28*a* of the punch 28 and the top surface 40*a* of the holder 40. In this state, as illustrated in FIG. 34(*b*), the punch 28 is moved together with the holder 40 in a direction in which the punch 28 and the holder 40 approach the die 25 relatively in the pressing direction X. By this means, forming is performed on the metal sheet 100, and the formed product 10 is obtained. Finally, the pad 26 and the punch 28 are moved to the other side in the pressing direction X relatively with respect to the support surface 24*a* of the die 25, and the formed product 10 is taken out.

Although a detailed description is omitted herein, in the press forming method according to the present embodiment also, similarly to the press forming method according to the first embodiment, a portion in the vicinity of the curved portion 30*a* (see FIG. 33) in the first portion 12*a* of the metal sheet 100 can be pinched by the deformation portion 34*b* of the die 25 and the deformation portion 38*b* of the pad 26 (see FIG. 3). Then, press forming can be performed on the metal sheet 100 in a state in which gradual bending of the portion of the first portion 12*a* which is pinched by the deformation portion 34*b* and the deformation portion 38*b* is allowed. As a result, in the present embodiment also, the occurrence of wrinkles at the first plate-shaped part 12 in the formed product 10 can be suppressed.

In addition, in the present embodiment, press forming is performed in a state in which the second portion 14*a* of the metal sheet 100 is pinched by the punch 28 and the holder 40. By this means, the occurrence of wrinkles at the second plate-shaped part 14 in the formed product 10 can be suppressed.

Note that, in the present embodiment also, similarly to the foregoing embodiment, the shapes and dimensions of the deformation portion 34*b* and the deformation portion 38*b* (see FIG. 3) can be appropriately changed. Furthermore, in the present embodiment also, the deformation portion 34*b* may be formed so as to be recessed with respect to the flat portion 34*a*, and the deformation portion 38*b* may be formed so as to protrude with respect to the flat portion 38*a*.

Further, the press forming method according to the present embodiment can also be favorably utilized when producing various kinds of formed products having a curved portion which, as viewed from the pressing direction, curves in a concave shape at the boundary part between the first plate-shaped part and the vertical wall part.

INDUSTRIAL APPLICABILITY

According to the present invention, the occurrence of wrinkles in a formed product can be suppressed, even in a case where it is difficult to control a distance between a pad and a die.

REFERENCE SIGNS LIST

10, 10*a*, 10*b* Formed Product
12 First Plate-shaped Part
12*a* First Portion
14 Second Plate-shaped Part
14*a* Second Portion
16 Vertical Wall Part
18, 20 Boundary Part
18*a*, 20*a* Curved Portion
22, 22*a* Press Apparatus
24, 25 Die
26 Pad
28 Punch
30, 32, 36 Edge of Support Surface
34*a*, 38*a* Flat Portion
34*b*, 38*b* Deformation Portion
40 Holder

The invention claimed is:

1. A press forming method in which, assuming a thickness direction of a metal sheet to be a pressing direction, a die is arranged on one side of the metal sheet in the pressing direction, and a pad and a punch are arranged on another side of the metal sheet in the pressing direction, and press forming is performed on the metal sheet by means of the die, the pad and the punch, the method comprising:

a first step of pinching one part of the metal sheet by means of the die and the pad, and a second step of, in a state in which the one part of the metal sheet is pinched by the die and the pad, moving the punch in a direction in which the punch approaches the die in the pressing direction relatively to perform press forming on the metal sheet, wherein:

the die has a first support surface which faces the pad in the pressing direction and which has an edge including a curved portion that curves so as to be recessed in an arc shape as viewed from the pressing direction, and a wall surface extending to the one side in the pressing direction from the edge of the first support surface;

the pad has a second support surface which faces the first support surface in the pressing direction;

the punch is provided on an opposite side to the first support surface with respect to the wall surface as viewed from the pressing direction;

the first support surface includes a first flat portion which extends in an orthogonal direction to the pressing direction, and a first deformation portion which protrudes or is recessed with respect to the first flat portion in the pressing direction;

the second support surface includes a second flat portion which faces the first flat portion in the pressing direction, and a second deformation portion which is recessed or protrudes with respect to the second flat portion so as to correspond to the first deformation portion;

the first deformation portion is provided on a normal line of the curved portion, as viewed from the pressing direction;

the first flat portion is provided continuously on both sides of the first deformation portion in a direction along the curved portion, as viewed from the pressing direction; and when a space between the first deformation portion and the second deformation portion is assumed to be a deformation space, in the second step, press forming is performed so that portions of the metal sheet which are on both sides of the deformation space in the direction along the curved portion as viewed from the pressing direction flow into the deformation space, and the metal sheet deforms along the first deformation portion and the second deformation portion in the deformation space.

2. The press forming method according to claim 1, wherein:

the first deformation portion includes at least one part of the curved portion.

3. The press forming method according to claim 2, wherein:

a length of a part of the curved portion that is included in the first deformation portion is 0.3 times or more an overall length of the curved portion.

4. The press forming method according to claim 1, wherein:

in the second step, the metal sheet in the deformation space deforms so as to form a single arc in a cross section orthogonal to the normal line of the curved portion as viewed from the pressing direction.

5. The press forming method according to claim 1, wherein:

a height or a depth of the first deformation portion with respect to the first flat portion in the pressing direction decreases as the first deformation portion extends away from the curved portion in a direction parallel to the normal line.

6. The press forming method according to claim 1, wherein:

in a cross section obtained by cutting the die and the metal sheet along a plane parallel to the pressing direction and passing through the normal line, a length of the first deformation portion in a parallel direction to the normal line is 0.1 times or more a length of the one part of the metal sheet that is pinched by the die and the pad in the first step.

7. The press forming method according to claim 1, wherein:

as viewed from the pressing direction, when a portion at which a curvature of the curved portion exhibits a local maximum value is assumed to be a reference point, the first deformation portion is provided on a normal line of the curved portion at the reference point.

8. The press forming method according to claim 7, wherein:

the first deformation portion is provided so as to include the reference point of the curved portion.

9. The press forming method according to claim 8, wherein:

in a cross section of the die that is parallel to the pressing direction and that passes through a tangential line of the curved portion at the reference point, a height or a depth of the first deformation portion with respect to the first flat portion in the pressing direction is 0.0001 times or more a length of the first deformation portion in a direction orthogonal to the pressing direction.

10. The press forming method according to claim 1, wherein:

before the first step, the metal sheet is subjected to predetermined forming processing.

11. The press forming method according to claim 1, wherein:

a holder is further arranged on the one side of the metal sheet in the pressing direction;

in the first step, the metal sheet is further pinched by the punch and the holder; and in the second step, in a state in which the metal sheet is pinched by the punch and the holder, the punch is moved in a direction in which the punch approaches the die in the pressing direction relatively to perform press forming on the metal sheet.

12. The press forming method according to claim 1, wherein:

the first deformation portion protrudes with respect to the first flat portion in the pressing direction;

the second deformation portion is recessed with respect to the second flat portion in the pressing direction; and a central portion of the second deformation portion in the direction along the curved portion is curved in a curved surface shape.

13. The press forming method according to claim 1, wherein:

the first deformation portion is recessed with respect to the first flat portion in the pressing direction;

the second deformation portion protrudes with respect to the second flat portion in the pressing direction; and a central portion of the first deformation portion in the direction along the curved portion is curved in a curved surface shape.

14. A press apparatus comprising the die, the pad and the punch used in the press forming method according to claim 1.

15. The press apparatus according to claim 14, further comprising a holder that is arranged so as to face the punch in the pressing direction.

* * * * *